US011071346B2

(12) United States Patent
Adamson et al.

(10) Patent No.: US 11,071,346 B2
(45) Date of Patent: Jul. 27, 2021

(54) TAPS AND TAP ATTACHMENT MECHANISMS FOR TAP SHOES

(71) Applicant: FDC THE FIT, Irvine, CA (US)

(72) Inventors: Ramona June Adamson, Anaheim Hills, CA (US); Darick Deon Parrish

(73) Assignee: FDC The Fit, Irvine, CA (US)

( * ) Notice: Subject to any disclaimer, the term of this patent is extended or adjusted under 35 U.S.C. 154(b) by 0 days.

(21) Appl. No.: 16/303,108

(22) PCT Filed: May 19, 2017

(86) PCT No.: PCT/US2017/033653
§ 371 (c)(1),
(2) Date: Nov. 19, 2018

(87) PCT Pub. No.: WO2017/201481
PCT Pub. Date: Nov. 23, 2017

(65) Prior Publication Data

US 2019/0297989 A1 Oct. 3, 2019

Related U.S. Application Data

(60) Provisional application No. 62/339,254, filed on May 20, 2016.

(51) Int. Cl.
*A43B 5/12* (2006.01)
*A43B 13/10* (2006.01)
(Continued)

(52) U.S. Cl.
CPC ..... *A43B 5/12* (2013.01); *A43B 13/10* (2013.01); *A43B 13/122* (2013.01); *A43B 13/36* (2013.01);
(Continued)

(58) Field of Classification Search
CPC ..... A43B 5/12; A43B 21/42; A43B 21/36; A43B 21/37; A43B 21/38; A43B 21/433;
(Continued)

(56) References Cited

U.S. PATENT DOCUMENTS 65,766 A * 6/1867 Riggs ..... A43B 13/36 36/15
748,490 A * 12/1903 Fadden ..... A43B 13/36 36/15
(Continued)

FOREIGN PATENT DOCUMENTS

FR 907688 A * 3/1946 ..... A43B 13/10
GB 191001191 A * 6/1910 ..... A43B 21/42
(Continued)

OTHER PUBLICATIONS

International Search Report received for International Application No. PCT/US2017/033653, dated Aug. 28, 2018, 3 pages.

*Primary Examiner* — Sharon M Prange
*Assistant Examiner* — Grace Huang
(74) *Attorney, Agent, or Firm* — Kubota & Basol LLP

(57) ABSTRACT

Examples of the disclosure are directed to a tap apparatus for attachment to a tap shoe. In some examples, the tap apparatus can include an upper tap portion that can be attached to the tap shoe, and a lower tap portion that covers and protects the fasteners used to attach the upper tap portion to the tap shoe. In some examples, the lower tap portion may slide onto the upper tap portion using a dovetail-like attachment mechanism. Screws or locking tabs may then be used to hold the lower tap portion in place. In some examples, the lower tap portion may be affixed to the upper tap portion using a threaded fastener, plug, or floating screw. In some examples, a tab in the upper tap portion can be retained in
(Continued)

an aperture in the tap portion, and the lower tap portion can be pivotably engaged with the upper tap portion.

12 Claims, 18 Drawing Sheets

(51) Int. Cl.

| | |
|---|---|
| ***A43B 13/36*** | (2006.01) |
| ***A43B 21/42*** | (2006.01) |
| ***A43B 13/12*** | (2006.01) |
| ***A43C 13/02*** | (2006.01) |
| ***A43C 13/12*** | (2006.01) |
| *A43B 21/40* | (2006.01) |

(52) U.S. Cl.
CPC ..... *A43B 21/42* (2013.01); *A43C 13/02* (2013.01); *A43C 13/12* (2013.01); *A43B 21/40* (2013.01)

(58) Field of Classification Search
CPC ..... A43B 21/437; A43B 21/44; A43B 21/45; A43B 21/46; A43B 21/52; A43C 13/12; A43C 13/04; A43C 13/02; A43C 13/36; A43C 13/122; A43C 13/10; A43C 13/28
USPC ..... 36/8.3
See application file for complete search history.

(56) References Cited

U.S. PATENT DOCUMENTS 769,157 A * 9/1904 Fischer ..... A43B 21/37 36/36 R
866,867 A * 9/1907 Kearney ..... A43B 21/37 36/36 R
1,247,132 A * 11/1917 Miklea ..... A43B 13/36 36/15
1,304,646 A * 5/1919 Barber ..... A43B 13/36 36/15
1,414,545 A * 5/1922 Boswell ..... A43B 21/50 36/36 R
1,432,340 A * 10/1922 Juriss ..... A43B 21/51 36/36 C
1,575,664 A * 3/1926 Van Roy ..... A43B 21/40 36/36 R
2,043,177 A * 6/1936 Kekoni ..... A43B 21/37 36/36 R
2,161,497 A * 6/1939 Yates ..... A43B 5/12 36/8.3
2,379,559 A * 7/1945 Wilson ..... A43B 21/42 36/36 R
2,538,170 A * 1/1951 Stritter ..... A43B 13/28 36/16
3,083,478 A * 4/1963 Rakus ..... A43B 21/42 36/36 R
4,489,719 A * 12/1984 Lapenskie ..... A61F 13/066 36/89
4,625,436 A * 12/1986 Stevens, Jr. ..... A43B 5/12 36/113
5,025,574 A 6/1991 Lasher, III
5,317,822 A * 6/1994 Johnson ..... A43B 13/36 36/101
5,459,946 A 10/1995 Rayow
6,598,317 B1 * 7/2003 Le Vine ..... A43B 5/12 36/15
6,711,833 B1 3/2004 Ransan
7,377,055 B2 * 5/2008 Bramani ..... A43B 5/145 36/131
7,434,335 B2 * 10/2008 Feldstein ..... A43B 5/12 36/15
10,028,551 B2 * 7/2018 Cavaliere ..... A43B 5/02
2004/0168347 A1 9/2004 Levine
2005/0120589 A1 * 6/2005 Coomes ..... A43B 3/0078 36/15
2009/0158619 A1 * 6/2009 Wittmers ..... A43B 13/10 36/8.3
2013/0298428 A1 * 11/2013 Tews ..... A43B 3/246 36/134
2018/0000234 A1 * 1/2018 White ..... A45F 5/021

FOREIGN PATENT DOCUMENTS

GB 191105020 A * 2/1912 ..... A43B 21/42
GB 191405483 A * 6/1915 ..... A43B 21/42

* cited by examiner

SECTION A-A

SECTION B-B

DETAIL C

SECTION A-A

TAPS AND TAP ATTACHMENT MECHANISMS FOR TAP SHOES

This application claims the benefit of priority to U.S. Provisional Patent Application No. 62/339,254, filed May 20, 2016, which is incorporated by reference herein in its entirety.

FIELD OF THE DISCLOSURE

This relates generally to tap shoes, and more particularly, to taps and tap attachment mechanisms for tap shoes.

BACKGROUND OF THE DISCLOSURE

Tap dancing is believed to have originated in the mid-1800s, and by the early 1900s had become established as a dance form. Since the origins of tap dancing, tap shoes have evolved from the insertion of nails or other metal pieces into the toes and heels of shoes, to wooden taps, and finally to metal taps. A tap dancer often creates sounds by repeatedly and rhythmically striking the taps on their tap shoes with percussive force against a hard surface. Some tap dance moves may involve spinning on the taps of the tap shoes, or temporarily applying the dancer's body weight to the edges of the taps.

Because tap dancers can generate strong vibrations and shock waves within their taps due to repetitive forces applied to the taps during their dance routines, the screws that attach the taps to the tap shoe may eventually break or become loose and back out, and any adhesives utilized to keep the taps and/or screws in place may eventually fail. In addition, various tap dance moves can cause tremendous forces such as shear and/or torsional forces to be applied to the taps, screws and adhesives of a tap shoe. Over time, these forces can cause the attachment screws and/or adhesives to fail.

Therefore, there is a need for taps and tap attachment mechanisms that provide for secure attachment of taps to tap shoes with a reduced risk of the taps falling off, or the tap attachment hardware breaking.

SUMMARY OF THE DISCLOSURE

Examples of the disclosure are directed to a tap apparatus for attachment to a tap shoe. In some examples, the tap apparatus can include an upper tap portion that can be attached to the tap shoe, and a lower tap portion that covers and protects the fasteners used to attach the upper tap portion to the tap shoe. In some examples, the lower tap portion may slide onto the upper tap portion using a dovetail-like attachment mechanism. Screws or locking tabs may then be used to hold the lower tap portion in place. In some examples, the lower tap portion may be affixed to the upper tap portion using a threaded fastener, which in some examples can be a screw/screw post combination. In some examples, the lower tap portion may include a plug that can be inserted into an aperture in the upper tap portion and rotated to secure the two together. In some examples, a floating screw can be held within the upper tap portion, and a tool can be used to threadably engage and tighten the floating screw with a threaded lower tap portion. In some examples, a tab in the upper tap portion can be retained in an aperture in the lower tap portion, and the lower tap portion can be pivotably engaged with the upper tap portion.

DETAILED DESCRIPTION

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

Examples of the disclosure are directed to a tap apparatus for attachment to a tap shoe. In some examples, the tap apparatus can include an upper tap portion that can be attached to the tap shoe, and a lower tap portion that covers and protects the fasteners used to attach the upper tap portion to the tap shoe. In some examples, the lower tap portion may slide onto the upper tap portion using a dovetail-like attachment mechanism. Screws or locking tabs may then be used to hold the lower tap portion in place. In some examples, the lower tap portion may be affixed to the upper tap portion using a threaded fastener, which in some examples can be a screw/screw post combination. In some examples, the lower tap portion may include a plug that can be inserted into an aperture in the upper tap portion and rotated to secure the two together. In some examples, a floating screw can be held within the upper tap portion, and a tool can be used to threadably engage and tighten the floating screw with a threaded lower tap portion. In some examples, a tab in the upper tap portion can be retained in an aperture in the lower tap portion, and the lower tap portion can be pivotably engaged with the upper tap portion.

Figure 1A:
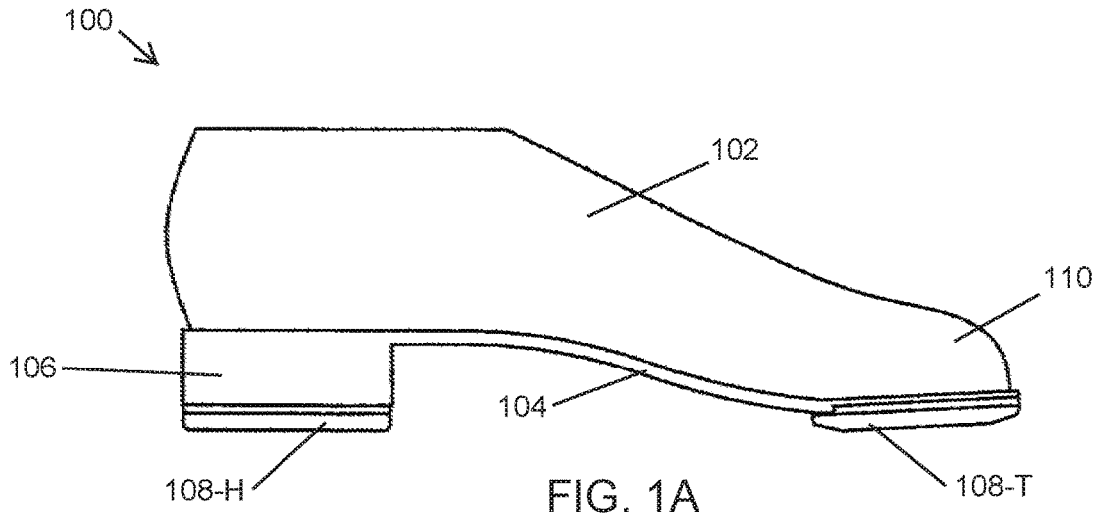
FIG. 1A illustrates a side view of a tap shoe according to some examples of the disclosure.

FIG. 1A illustrates a side view of tap shoe 100 according to some examples of the disclosure. Tap shoe 100 can include upper 102, which is often made of leather, sole 104, heel 106, and taps attached to the heel and toe area. Tap shoe 100 may include both toe tap 108-T and heel tap 108-H, as shown in FIG. 1A, although some examples may contain only a toe tap or only a heel tap. Some tap shoes 100 may contain toe box 110, which is a reinforced area around the toes.

Figure 1B:
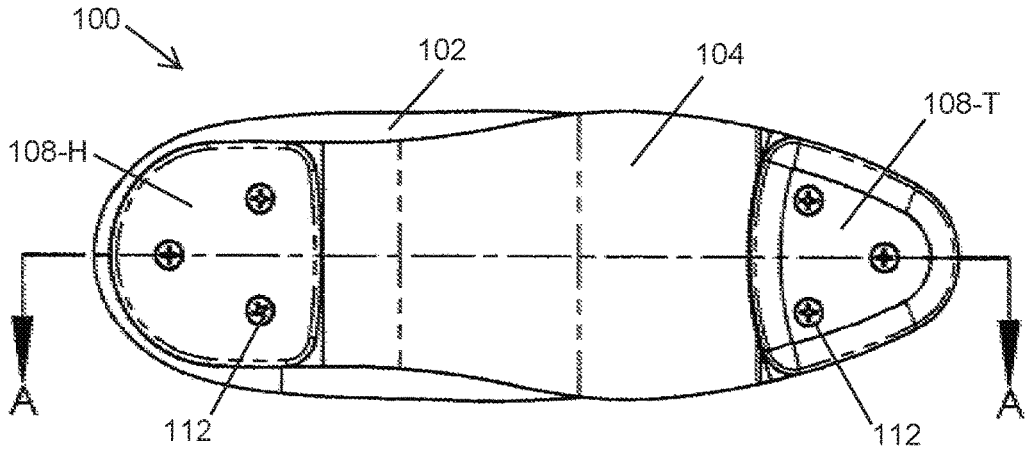
FIG. 1B illustrates a bottom view of a tap shoe according to some examples of the disclosure.

FIG. 1B illustrates a bottom view of tap shoe 100 according to some examples of the disclosure. Taps 108-T and/or 108-H can be made from a metal such as aluminum or various aluminum alloys, steel or anodized forged steel, and others, and can be attached to the bottom of tap shoe 100 using fasteners (e.g., screws, screw/screw post combinations, threaded inserts, bolt/nut combinations, clevis pin/pin combinations, nails, tacks, staples, grommets, rivets and the like, other hardware such as washers, lock washers, etc., and/or one or more compounds such as adhesives) 112. Although three fasteners are illustrated in the example of FIG. 1B for each of taps 108-T and 108-H, any number of fasteners can be used. (It should be noted that although fasteners may be illustrated throughout the drawings as screws, the term "fasteners" can include hardware other than screws, and non-hardware fasteners such as the compounds described above.) In some examples, taps 108-T and/or 108-H can be attached through an intervening soundboard or other intermediate structure (not shown in FIG. 1B), which can be attached using either or both of fasteners 112 and compounds. (The term "soundboard" will be used throughout the remainder of this disclosure to include both soundboards and other intermediate structures.)

Figure 1D:
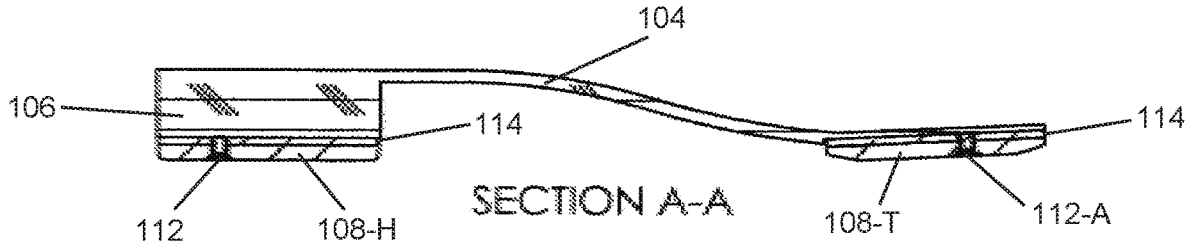
FIG. 1D illustrates a side cross-sectional view of the example tap shoe of FIG. 1B, taken along the lines A-A shown in FIG. 1B, according to some examples of the disclosure.
Figure 1C:
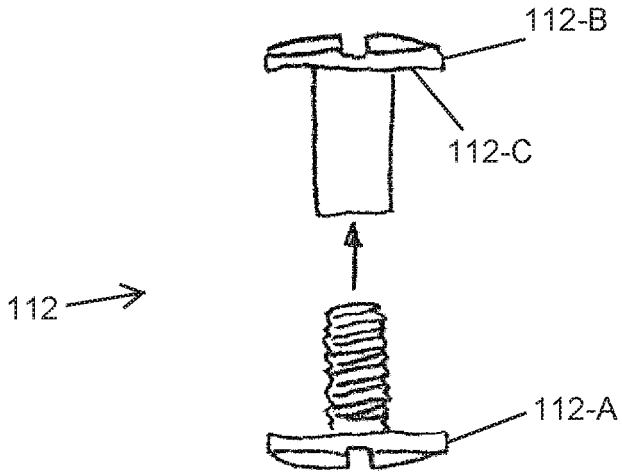
FIG. 1C illustrates a side perspective view of a fastener in the form of a screw and screw post according to some examples of the disclosure.

FIG. 1C illustrates a side perspective view of fastener 112 in the form of screw 112-A and screw post 112-B according to some examples of the disclosure. In some examples, screw post 112-B can be inserted downward through an aperture in the sole and/or soundboard of the tap shoe (not shown in FIG. 1C) such that flange 112-C of the screw post engages with the sole and/or soundboard to prevent the screw post and screw 112-A from pulling out from the bottom of the tap shoe. In some examples, flange 112-C of screw post 112-B can have one or more downward-facing points (not shown in FIG. 1C) for penetrating into the sole and/or soundboard to prevent the screw post from rotating and/or releasing from the sole and/or soundboard. Although the example of FIG. 1C illustrates a screw 112-A and screw post 112-B combination, in other examples different types of fasteners or attachment mechanisms, such as a two-piece grommet assembly, threaded insert, or a rivet can also be used.

FIG. 1D illustrates a side cross-sectional view of the example tap shoe 100 of FIG. 1B, taken along the lines A-A shown in FIG. 1B, according to some examples of the disclosure. In the example of FIG. 1D, heel tap 108-H can be secured to either or both of soundboard 114 and heel 106 using fasteners 112 that can be installed through apertures in the heel tap for engagement with either or both of the soundboard and heel. Soundboard 114 may be formed from fiberglass or other thin, lightweight material, and can be attached to heel 106 and/or sole 104 of tap shoe 100 using fasteners such as staples, screws, screw/screw post combinations, threaded inserts, bolt/nut combinations, clevis pin/pin combinations, nails, tacks, grommets, rivets or other hardware, other hardware such as washers, lock washers, etc., compounds such as adhesives, or a combination of these and other attachment means. As shown in FIG. 1D, soundboard 114 can be made out of a thin material such as fiberboard. One function of soundboard 114 is to keep the tap attached to sole 104. Even if fasteners 112 become loose, the threads (if any) on fastener 112 can catch and be retained by the soundboard, preventing the fastener from falling out completely. In addition, soundboard 114 can alter sound quality (e.g., create a tonal shift) depending on how securely the tap is pressed against the soundboard.

In the example of FIG. 1D, toe tap 108-T can be secured to either or both of soundboard 114 and sole 104 using screws 112-A that can be installed through apertures in the toe tap for engagement with either or both of the soundboard and sole. A screw post (not shown in FIG. 1D) can be inserted downward through an aperture in sole 104 and/or soundboard 114 of tap shoe 100 for threaded engagement with screw 112-A. Although the example of FIG. 1D illustrates screw 112-A for use in combination with a screw post, in other examples different types of attachment mechanisms, such as a two-piece grommet assembly, threaded insert, or a rivet can also be used.

Figure 1E:
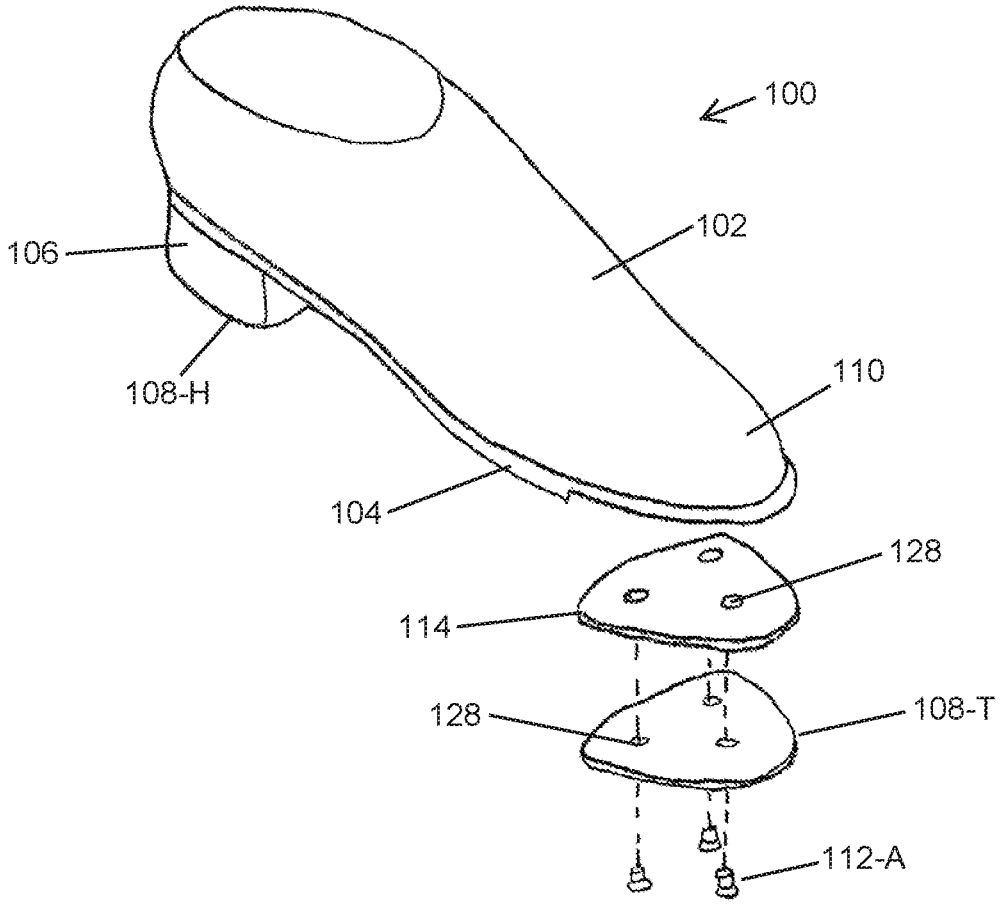
FIG. 1E illustrates a perspective top view of a tap shoe and an exploded perspective top view of a toe tap according to some examples of the disclosure.

FIG. 1E illustrates a perspective top view of tap shoe 100 and an exploded perspective top view of toe tap 108-T with screws 112-A passing through apertures 128 in toe tap 108-T and soundboard 114 for threaded engagement with a screw post (not shown in FIG. 1E) penetrating downward through sole 104 according to some examples of the disclosure. Although the example of FIG. 1E illustrates screw 112-A for use in combination with a screw post, in other examples different types of attachment mechanisms, such as a two-piece grommet assembly, threaded insert, or a rivet can also be used. In addition, although three fasteners are shown, in other examples any number of fasteners can be employed.

To install toe tap 108-T, screw post 112-B can first be installed downward through either or both of soundboard 114 and sole 104 of tap shoe 100. In examples where screw post 112-B is installed only through soundboard 114, soundboard can be affixed to sole 104 using one or more fasteners (e.g., screws, screw/screw post combinations, threaded inserts, bolt/nut combinations, clevis pin/pin combinations, nails, tacks, grommets, rivets, staples or the like, other hardware such as washers, lock washers, etc., and/or compounds such as adhesives). Screws 112-A can then be inserted up through apertures 128 in toe tap 108-T and threaded into screw posts 112-B. In this manner, a metal-to-metal threaded connection can be formed to prevent screws 112-A from breaking or at least partially disengaging (e.g., backing out or loosening). In addition, because the enlarged head of screw post 112-B is engaged with either soundboard 114 or sole 104, it can be less likely to pull through the soundboard or sole.

Figure 2B:
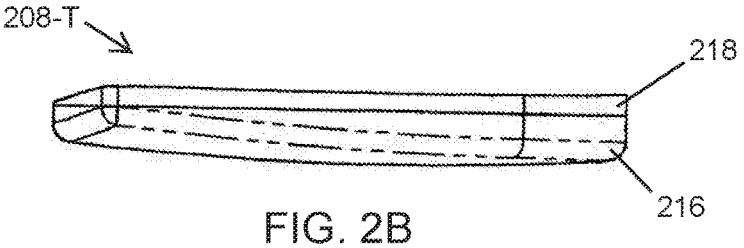
FIG. 2B illustrates a side view of a toe tap showing a lower tap portion and an upper tap portion adjacent to each other according to some examples of the disclosure.
Figure 2C:
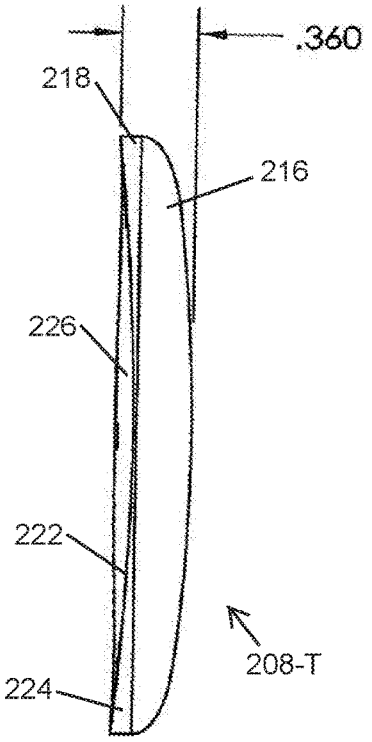
FIG. 2C illustrates a back view of a toe tap showing a lower tap portion and an upper tap portion according to some examples of the disclosure.
Figure 2A:
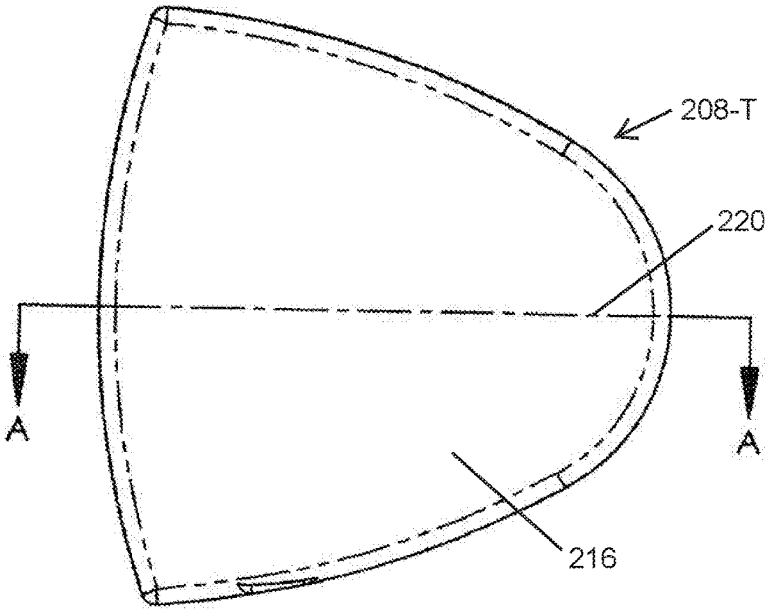
FIG. 2A illustrates a bottom orthographic view of a toe tap showing a lower tap portion transversely attached with respect to the longitudinal axis of the toe tap using a dovetail attachment mechanism according to some examples of the disclosure.

FIG. 2A illustrates a bottom orthographic view of toe tap 208-T showing lower tap portion 216 transversely attached with respect to longitudinal axis 220 of the toe tap using a dovetail attachment mechanism according to some examples of the disclosure. In the example of FIG. 2A, lower tap portion 216 is free of holes or other apertures for screws, screw/screw post combinations, threaded inserts, bolt/nut combinations, clevis pin/pin combinations, grommets, rivets, nails, tacks, staples, or other attachment hardware, though in other examples lower tap portion may have one or more holes or apertures for attachment hardware. Although lower tap portion 216 is shown as being generally half-oval shaped, in other examples the lower tap portion can be formed into any shape appropriate for a tap shoe.

FIG. 2B illustrates a side view of toe tap 208-T showing lower tap portion 216 and upper tap portion 218 adjacent to each other according to some examples of the disclosure. In the example of FIG. 2B, lower tap portion 216 and upper tap portion 218 may be made from metal such as aluminum or various aluminum alloys, steel or anodized forged steel, and others, though in other examples they may be made from other materials such as wood, plastic, fiberboard and the like.

FIG. 2C illustrates a back view of toe tap 208-T showing lower tap portion 216 and upper tap portion 218 according to some examples of the disclosure. In the example of FIG. 2C, upper tap portion 218 can be slightly concave at the rear (see reference number 222 in FIG. 2C), gradually thickening toward side edges 224, although in other examples the upper tap portion need not be concave. These thicker edges can result in a cavity 226 being formed between upper tap portion 218 and a soundboard or sole of the shoe (not shown in FIG. 2C), which can produce advantageous and desirable sound characteristics. Note that although FIG. 2C indicates a thickness of 0.360 inches for toe tap 208-T, it should be understood that this dimension is only an example, and that other thicknesses can be employed according to other examples of the disclosure.

Figure 2D:
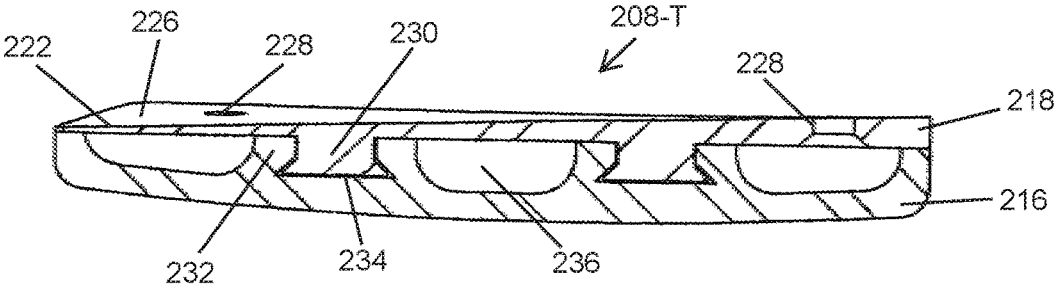
FIG. 2D illustrates a side cross-sectional view of a toe tap taken along the lines A-A in FIG. 2A according to some examples of the disclosure.

FIG. 2D illustrates a side cross-sectional view of toe tap 208-T taken along the lines A-A in FIG. 2A according to some examples of the disclosure. In the example of FIG. 2D, apertures 228 are shown in upper tap portion 218 for attaching the upper tap portion to the sole of the tap shoe and/or a soundboard (not shown in FIG. 2D). One or more raised areas (not shown in FIG. 2D) can be formed on the upper surface of lower tap portion 216 in alignment with apertures 228 in upper tap portion 218 to prevent fasteners within the apertures from at least partially disengaging (e.g., backing out or loosening). Upper tap portion 218 can also include one or more projections (e.g., tenons, rails and the like) 230 extending downward from the upper tap portion. Lower tap portion 216 can also include one or more raised areas (e.g., mesas, plateaus and the like) 232 containing one or more recesses (e.g., mortises, sockets, notches and the like) 234 for receiving projections 230. Although the projections 230 and recesses 234 shown in FIG. 2D are formed in "dovetail" shapes, in other examples different interlocking shapes may also be employed. In addition, although two dovetails are shown in FIG. 2D, in other examples different numbers of dovetails can be employed. Although FIG. 2D shows lower tap portion 216 with recesses 234 and upper tap portion 218 with projections 230, in other examples the lower tap portion can contain the projections and the upper tap portion can contain the recesses, and in other examples each of the upper and lower tap portions can contain both recesses and projections. Furthermore, although FIG. 2D shows recesses 234 and projections 230 integrally (continuously) formed as part of lower tap portion 216 and upper tap portion 218, respectively, in other examples the recesses and projections can be formed from separate material that is then affixed to the lower and upper tap portions. In either case, recesses 234 and projections 230 are described as being "formed with" lower tap portion 216 and upper tap portion 218. (The term "formed with" is used in a similar manner throughout this disclosure.) Toe tap 208-T can also contain one or more cavities 236 formed between raised areas 232 and beneath upper tap portion 218, which can produce advantageous and desirable sound characteristics. In some examples, loose material can additionally be placed in the one or more cavities 236 to produce distinctive sounds. In other examples, toe tap 208-T can be substantially solid and without cavities when upper tap portion 218 and lower tap portion 216 are engaged.

Figure 2E:
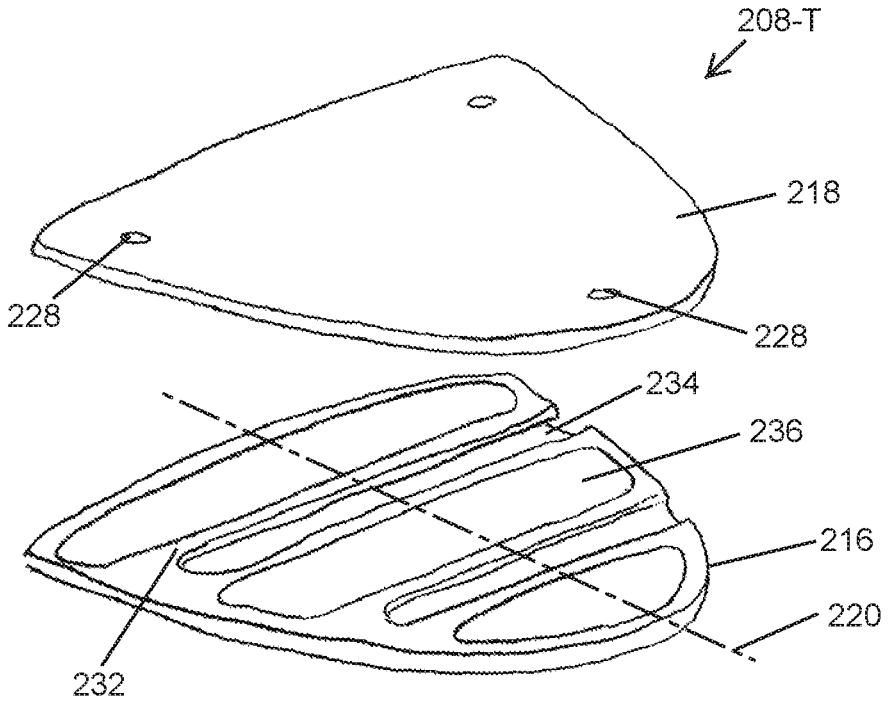
FIG. 2E illustrates perspective top views of an upper tap portion and a lower tap portion according to some examples of the disclosure.

FIG. 2E illustrates perspective top views of upper tap portion 218 and lower tap portion 216 according to some examples of the disclosure. In the example of FIG. 2E, raised areas 232, recesses 234 and cavities 236 are shown as being laterally formed transverse to longitudinal axis 220 of toe tap 208-T within the plane of the lower tap portion 216, although in other examples other orientations with respect to the longitudinal axis are contemplated. FIG. 2E also shows an example arrangement of three apertures (e.g., holes) 228 in upper tap portion 218 for attaching the upper tap portion to the sole of the tap shoe and/or a soundboard (not shown in FIG. 2E) using fasteners such as screws, screw/screw post combinations, threaded inserts, bolt/nut combinations, clevis pin/pin combinations, grommets, rivets, nails, staples, tacks and the like, and other hardware such as washers, lock washers, etc., although it should be understood that different numbers of apertures, and different arrangements of apertures, may also be employed. In addition, although FIG. 2E illustrates recesses 234 as being opened on only one transverse end, in other examples the recesses may be open at the other transverse end, or at both ends if an additional securement mechanism is provided for lower tap portion 216. The dovetail arrangement of FIG. 2E can be advantageous in that it can cover up attachment hardware for the upper tap portion, which can protect the hardware and prevent it from breakage, loosening, and the like, and can be advantageous because lower tap portion 216 may only be secured with a metal-to-metal joint that may be less likely to slip off in a transverse direction. In some examples, after lower tap portion 216 is engaged with upper tap portion 218, they can additionally be secured together with one or more fasteners (e.g., screws such as set-screws) that pass through apertures in both the lower and upper tap portions, snap locking tabs (discussed hereinbelow), and/or other hardware.

To install toe tap 208-T, upper tap portion 218 can first be affixed to either or both of soundboard and sole (not shown in FIG. 2E) using one or more fasteners (e.g., screws, screw/screw post combinations, threaded inserts, bolt/nut combinations, clevis pin/pin combinations, staples, nails, tacks, grommets, rivets, or the like, other hardware such as washers, lock washers, etc., and/or compounds such as adhesives). Next, recesses 234 on lower tap portion 216 can be aligned with projections on upper tap portion 218, and after alignment the lower tap portion can be transversely mated with the upper tap portion using the recesses and projections by sliding the upper and lower tap portions together. In this manner, a metal-to-metal slide-on connection can be formed to prevent the fasteners on upper tap portion 218 from breaking or partially/fully disengaging (e.g., backing out or loosening).

Figure 2F:
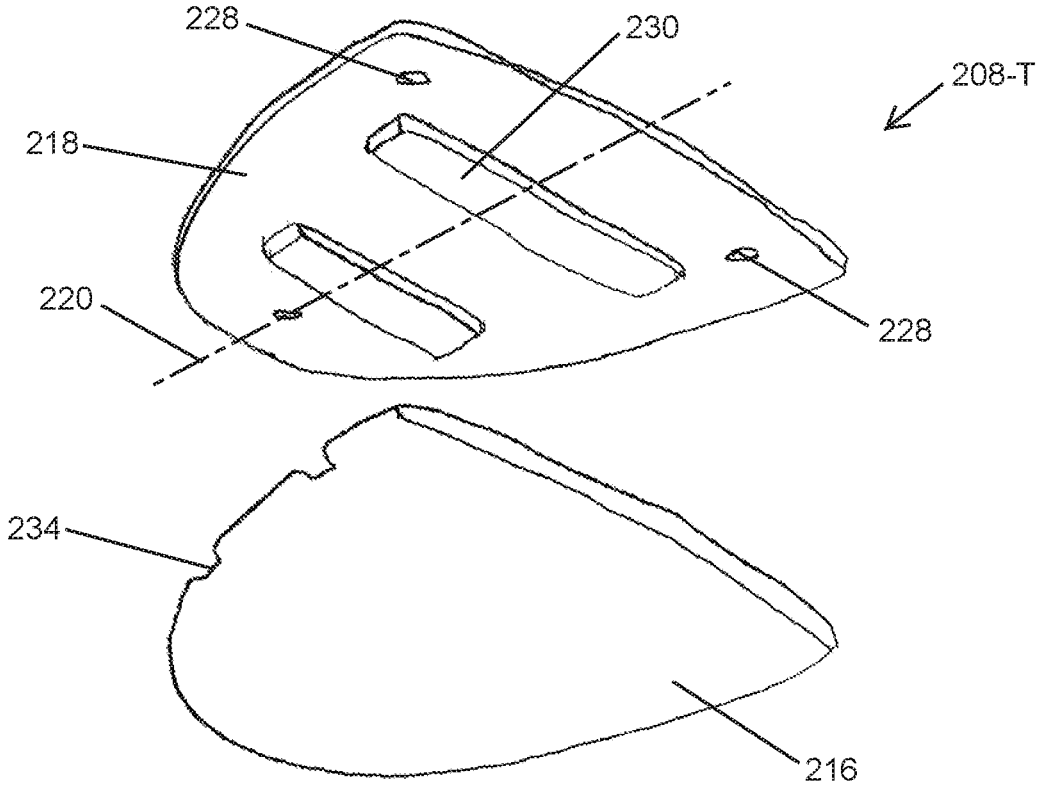
FIG. 2F illustrates a perspective bottom view of an upper tap portion and a lower tap portion according to some examples of the disclosure.

FIG. 2F illustrates a perspective bottom view of upper tap portion 218 and lower tap portion 216 according to some examples of the disclosure. In the example of FIG. 2F, projections 230 are shown as being laterally formed transverse to longitudinal axis 220 of toe tap 208-T in a plane parallel to the upper tap portion, although in other examples other orientations with respect to the longitudinal axis are contemplated.

Although FIGS. 2A-2F and the accompanying text above illustrate and describe toe tap 208-T, it should be understood that some examples of the disclosure are also applicable to a heel tap. In some examples, the heel tap may be less pointed (more rounded), but at least some of the same features disclosed above can be applied to the heel tap as well.

Figure 3A:
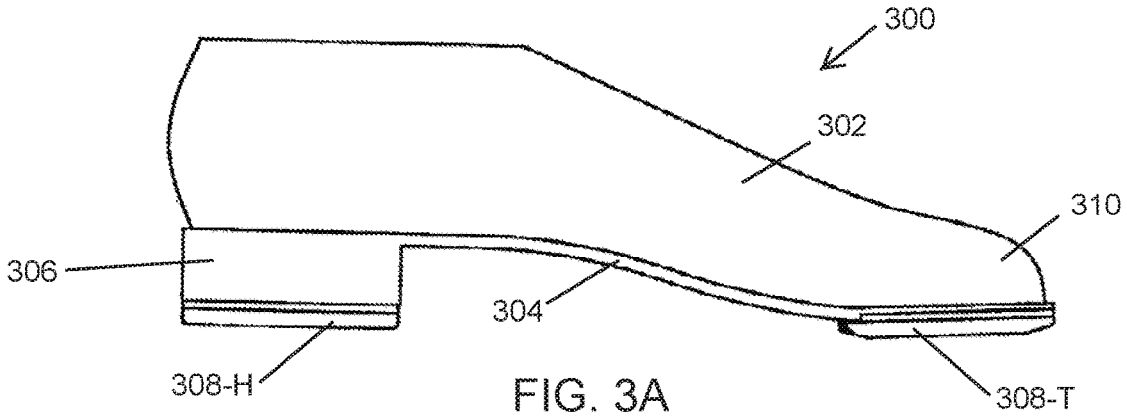
FIG. 3A illustrates a side view of a tap shoe employing a dovetail and snap locking tap attachment mechanism according to some examples of the disclosure.

FIG. 3A illustrates a side view of tap shoe 300 employing a dovetail and snap locking tap attachment mechanism according to some examples of the disclosure. Tap shoe 300 can include upper 302, which is often made of leather, sole 304, heel 306, and taps 308-H and 308-T attached to the heel and toe area. Some tap shoes 300 may contain toe box 310, which is a reinforced area around the toes.

Figure 3B:
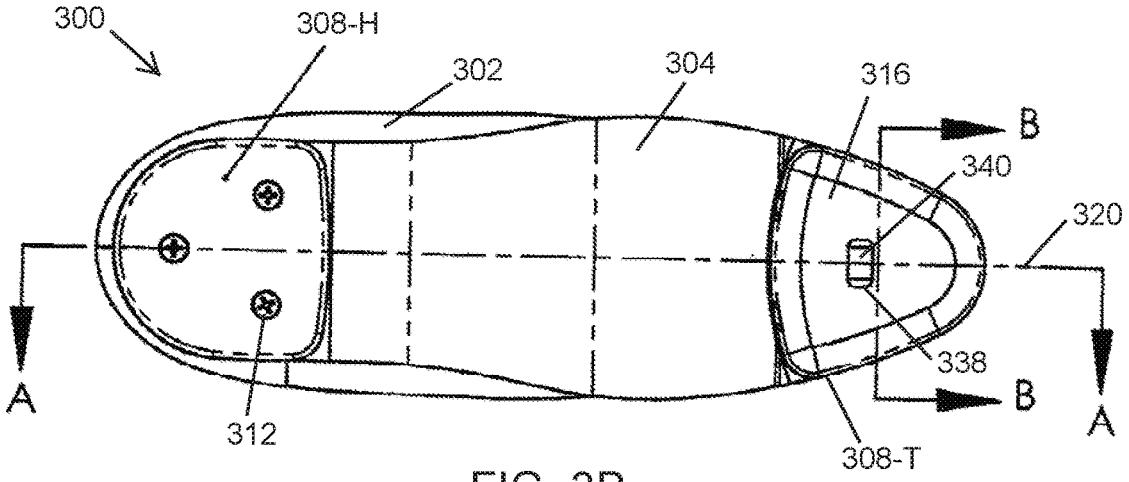
FIG. 3B illustrates a bottom view of a tap shoe according to some examples of the disclosure.

FIG. 3B illustrates a bottom view of tap shoe 300 according to some examples of the disclosure. In the example of FIG. 3B, heel tap 308-H may be made from aluminum or various aluminum alloys, steel or anodized forged steel, and others, and can be attached to the bottom of tap shoe 300 using fasteners (e.g., screws, screw/screw post combinations, threaded inserts, bolt/nut combinations, clevis pin/pin combinations, nails, tacks, staples, grommets, rivets and the like, and other hardware such as washers, lock washers, etc., and/or compounds such as adhesives) 312 through an optional intervening soundboard (not shown in FIG. 3B). FIG. 3B also illustrates a bottom view of a toe tap 308-T showing lower tap portion 316 longitudinally attached with respect to longitudinal axis 320 of the toe tap using a dovetail and snap locking tab attachment mechanism according to some examples of the disclosure. In the example of FIG. 3B, lower tap portion 316 is free of holes or other apertures for screws, screw/screw post combinations, threaded inserts, bolt/nut combinations, clevis pin/pin combinations, nails, tacks, staples, grommets, rivets or other fasteners or attachment hardware, though aperture 338 can be formed in lower tap portion 316 to receive snap locking tab 340, and also enable the snap locking tab to be released when in a locked position. Although only one aperture 338 and snap locking tab 340 pair are shown in FIG. 3B, in other examples more than one aperture and snap locking tab may be employed. Although lower tap portion 316 is shown as being generally half-oval shaped, in other examples the lower tap portion can be formed into any shape appropriate for a tap shoe.

Figure 3C:
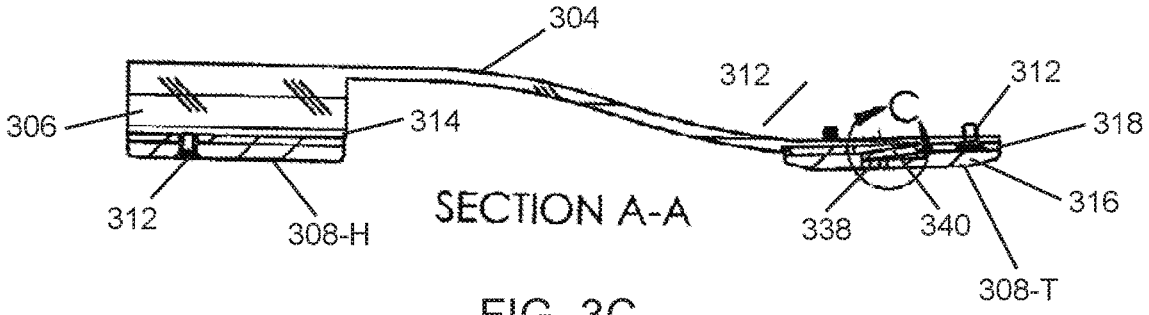
FIG. 3C illustrates a side cross-sectional view of the example tap shoe of FIG. 3B, taken along the lines A-A shown in FIG. 3B, according to some examples of the disclosure.

FIG. 3C illustrates a side cross-sectional view of example tap shoe 300 of FIG. 3B, taken along the lines A-A shown in FIG. 3B, according to some examples of the disclosure. FIG. 3C illustrates a side cross-section view of heel tap 308-H with fasteners 312 penetrating upward and being threaded through optional soundboard 314, which may be formed from a fiberglass or other thin, lightweight material. Soundboard 314 can be attached to sole 304 and heel 306 of tap shoe 300 using fasteners such as staples, screws, screw/screw post combinations, threaded inserts, bolt/nut combinations, clevis pin/pin combinations, nails, tacks, grommets, rivets or other hardware such as washers, lock washers, etc., compounds such as adhesives, or a combination of these and other attachment means. FIG. 3C also illustrates a side cross-sectional view of toe tap 308-T including lower tap portion 316 and upper tap portion 318 mated with each other according to some examples of the disclosure. In the example of FIG. 3C, lower tap portion 316 and upper tap portion 318 may be made from metal such as aluminum or various aluminum alloys, steel or anodized forged steel, and others, though in other examples they may be made from other materials such as wood, plastic, fiberboard and the like. Aperture 338 can be formed in lower tap portion 316, and snap locking tab 340 can be formed integral with upper tap portion 318.

Figure 3D:
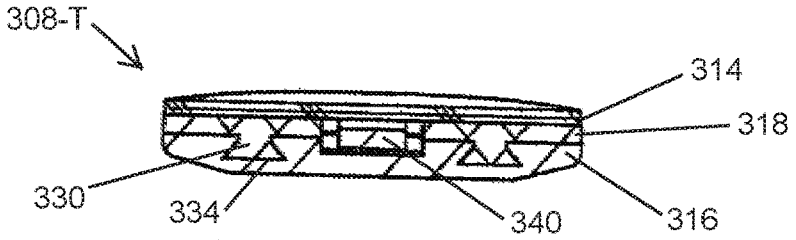
FIG. 3D illustrates a side cross-sectional view of a toe tap taken along the lines B-B in FIG. 3B according to some examples of the disclosure.

FIG. 3D illustrates a side cross-sectional view of toe tap 308-T taken along the lines B-B in FIG. 3B according to some examples of the disclosure. In the example of FIG. 3D, upper tap portion 318 can also include one or more projections (e.g., tenons, rails or the like) 330 extending downward from the upper tap portion. Lower tap portion 316 can also include one or more recesses (e.g., mortises, sockets, notches or the like) 334 for receiving projections 330. Although the projections 330 and recesses 334 shown in the example of FIG. 3D are formed in "dovetail" shapes of tenons and mortises, in other examples different interlocking shapes may also be employed. In addition, although two dovetails are shown in FIG. 3D, in other examples different numbers of dovetails can be employed. Furthermore, although the example of FIG. 3D shows projections 330 extending from upper tap portion 318 and recesses 334 formed in lower tap portion 316, in other examples the projections can extend from the lower tap portion and the recesses can be formed in upper tap portion. In other examples, each of upper tap portion 318 and lower tap portion 316 can contain both recesses 334 and projections 330. In addition, it should be noted that although FIG. 3D shows top tap 308-T being substantially solid when lower tap portion 316 and upper tap portion 318 are engaged, in other examples cavities may be formed within the toe tap, which can produce desirable sound characteristics.

Figure 3E:
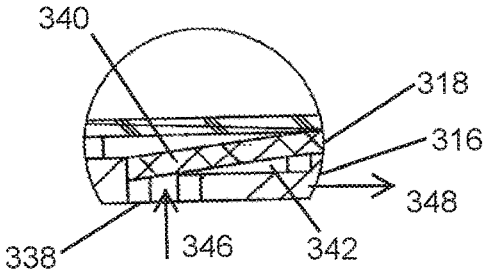
FIG. 3E illustrates a side cross-sectional view of Detail C shown in FIG. 3C according to some examples of the disclosure.

FIG. 3E illustrates a side cross-sectional view of Detail C shown in FIG. 3C according to some examples of the disclosure. In the example of FIG. 3E, recess 342 and aperture 338 can be formed in lower tap portion 316, and snap locking tab 340 can be formed integral with upper tap portion 318. Snap locking tab 340 can be formed to have a resting or equilibrium position that is bent downward at an angle with respect to the plane of the remainder of upper tap portion 318, so that as lower tap portion 316 is pushed into the upper tap portion, the snap locking tab will temporarily straighten and be under tension. When lower tap portion 316 is pushed all the way into upper tap portion 318, snap locking tab 340 will drop into recess 342, and the distal end of snap locking tab 340 will drop into aperture 338. In some examples, if lower tap portion 316 is to be removed, a tool can be used to push up on snap locking tab 340 in the direction of arrow 346 until the snap locking tab disengages from recess 342 and the lower tap portion can slide in the direction of arrow 348.

Figure 3F:
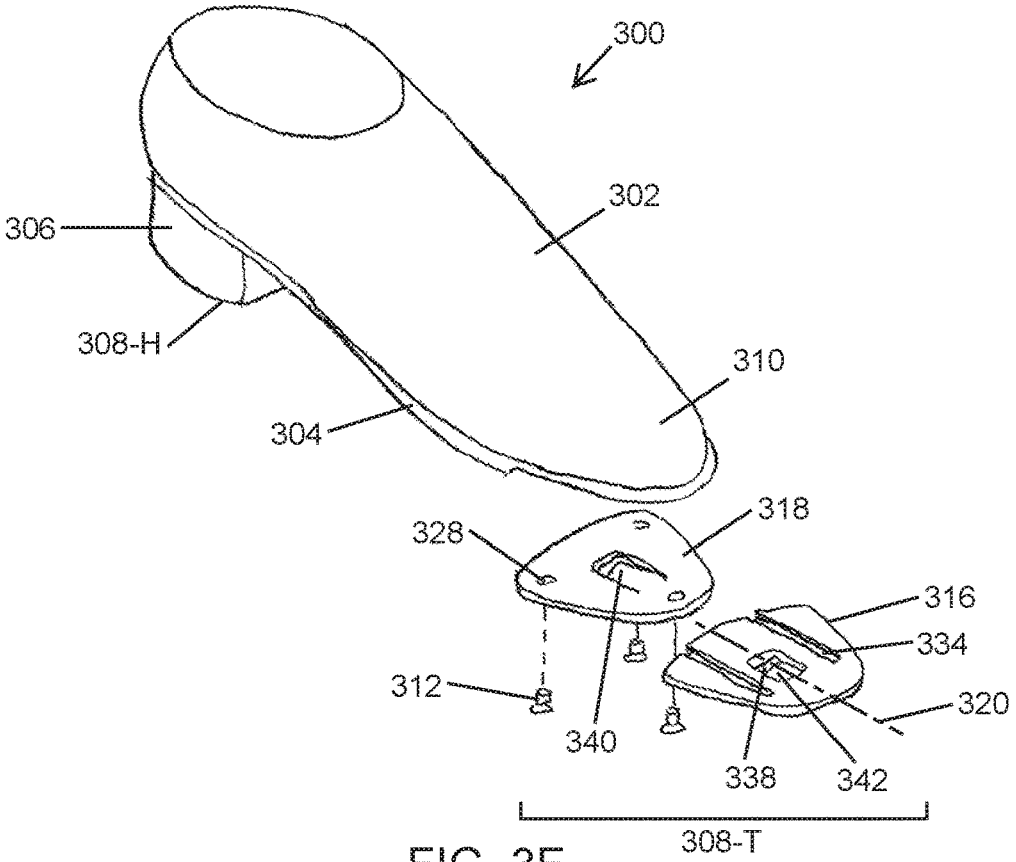
FIG. 3F illustrates a perspective top view of a tap shoe and an exploded perspective top view of a toe tap including an upper tap portion and a lower tap portion according to some examples of the disclosure.

FIG. 3F illustrates a perspective top view of tap shoe 300 and an exploded perspective top view of toe tap 308-T including upper tap portion 318 and lower tap portion 316 according to some examples of the disclosure. In the example of FIG. 3F, one or more recesses 334 can be laterally formed parallel to longitudinal axis 320 of toe tap 308-T within the plane of lower tap portion 316, and projections (not shown in FIG. 3F) can be laterally formed parallel to the longitudinal axis of the toe tap in the underside of upper tap portion 318 in a plane parallel to the upper tap portion, although in other examples, different orientations are contemplated. FIG. 3F also shows an example arrangement of three apertures 328 in upper tap portion 318 for attaching the upper tap portion to the sole of the tap shoe and/or a soundboard (not shown in FIG. 3F) using fasteners 312, although it should be understood that different numbers of apertures, and different arrangements of apertures, may also be employed. In addition, although FIG. 3F illustrates recesses 334 as being opened on only one longitudinal end, in other examples the recesses may be open at both ends.

To install toe tap 308-T, upper tap portion 318 can first be affixed to sole 304, optionally through a soundboard (not shown in FIG. 3F), using fasteners 312 and/or adhesives. In some examples, the top of upper tap portion 318 can be textured to provide a gripping surface for the adhesive. Next, lower tap portion 316 can be slid into upper tap portion 318 using recesses 334 and the projections until snap locking tab 340 locks into place within recess 342 and aperture 338. The dovetail arrangement of FIG. 3F can be advantageous in that it can cover up attachment hardware for the upper tap portion, which can protect the hardware and prevent it from breakage, loosening, and the like, and can be advantageous because lower tap portion 316 may only be secured with a metal-to-metal joint and snap locking tab that may be less likely to slip off.

Although FIGS. 3B-3F and the accompanying text above illustrate and describe toe tap 308-T with a dovetail and snap locking tab attachment mechanism, it should be understood that examples of the disclosure are equally applicable to a heel tap. In some examples, the heel tap may be less pointed (more rounded), but the same features disclosed above can be applied to the heel tap as well.

It should be noted that the locking snap locking tab of FIGS. 3A-3F can also be employed at the far end of the recesses and projections in the dovetail mechanism of FIGS. 2A-2F.

Figure 4A:
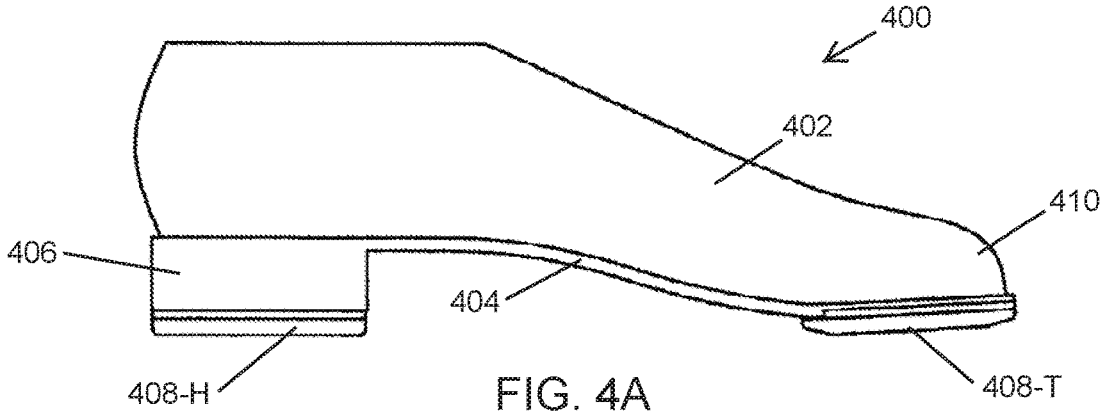
FIG. 4A illustrates a side view of a tap shoe employing a screw attachment mechanism according to some examples of the disclosure.

FIG. 4A illustrates a side view of tap shoe 400 employing a screw attachment mechanism according to some examples of the disclosure. Tap shoe 400 can include upper 402, which is often made of leather, sole 404, heel 406, and taps 408-H and 408-T attached to the heel and toe area. Some tap shoes 400 may contain toe box 410, which is a reinforced area around the toes.

Figure 4B:
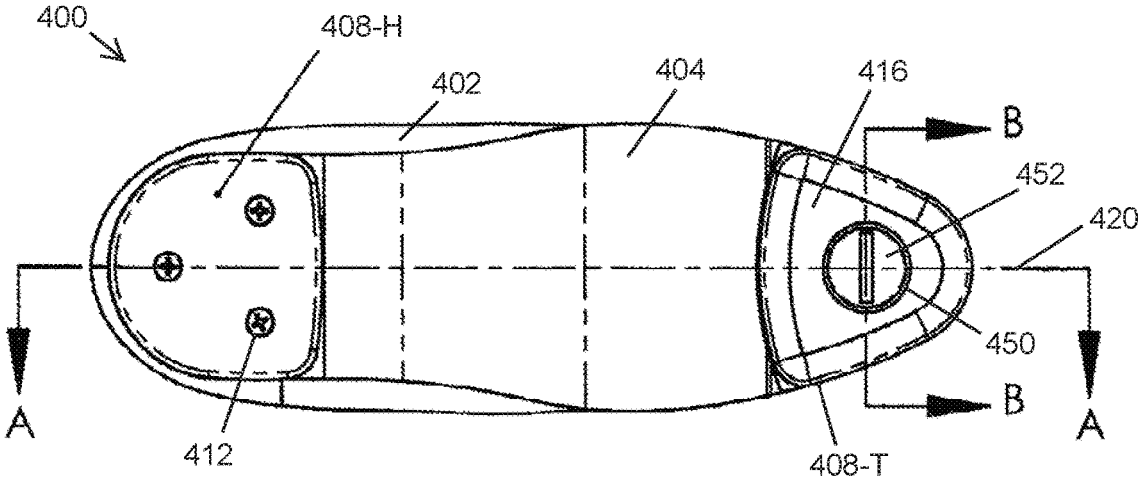
FIG. 4B illustrates a bottom view of a tap shoe according to some examples of the disclosure.

FIG. 4B illustrates a bottom view of tap shoe 400 according to some examples of the disclosure. In the example of FIG. 4B, heel tap 408-H may be made from aluminum or various aluminum alloys, steel or anodized forged steel, and others, and can be attached to the bottom of tap shoe 400 using fasteners (e.g., screws, screw/screw post combinations, threaded inserts, bolt/nut combinations, clevis pin/pin combinations, nails, tacks, staples, grommets, rivets and the like, and other hardware such as washers, lock washers, etc.) 412 through an optional intervening soundboard (not shown in FIG. 4B), and may also utilize various compounds such as adhesives. FIG. 4B also illustrates a bottom view of toe tap 408-T showing lower tap portion 416 attached using a screw attachment mechanism according to some examples of the disclosure. In the example of FIG. 4B, lower tap portion 416 is free of holes or other apertures for screws, screw/screw post combinations, threaded inserts, bolt/nut combinations, clevis pin/pin combinations, nails, staples, tacks, grommets, rivets or other attachment hardware except for aperture 450 formed in the lower tap portion to receive fastener (e.g., screw, screw/screw post combination, and the like) 452. Although one aperture 450 is shown in FIG. 4B, in other examples a plurality of apertures may be employed. Although lower tap portion 416 is shown as being generally half-oval shaped, in other examples the lower tap portion can be formed into any shape appropriate for a tap shoe.

Figure 4C:
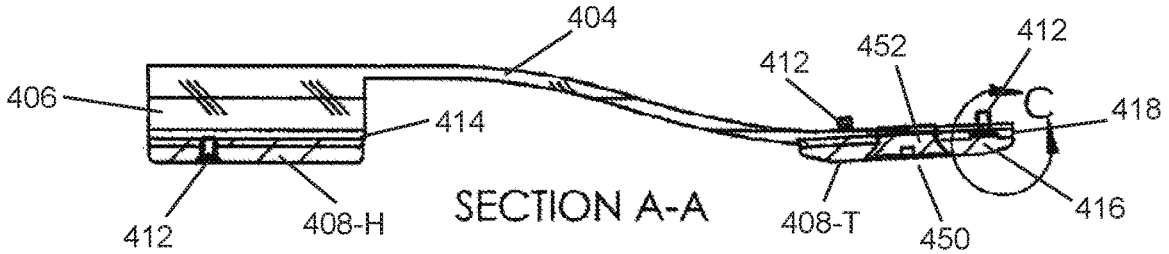
FIG. 4C illustrates a side cross-sectional view of the example tap shoe of FIG. 4B, taken along the lines A-A shown in FIG. 4B, according to some examples of the disclosure.

FIG. 4C illustrates a side cross-sectional view of example tap shoe 400 of FIG. 4B, taken along the lines A-A shown in FIG. 4B, according to some examples of the disclosure. FIG. 4C illustrates a side cross-sectional view of heel tap 408-H with fasteners 412 penetrating upward and being threaded through optional soundboard 414, which may be formed from fiberglass or other thin, lightweight material. Soundboard 414 can be attached to sole 404 and heel 406 of tap shoe 400 using fasteners such as staples, screws, screw/screw post combinations, threaded inserts, bolt/nut combinations, clevis pin/pin combinations, nails, tacks, grommets, rivets or other hardware such as washers, lock washers, etc., compounds such as adhesives, or a combination of these and other attachment means. FIG. 4C also illustrates a side cross-sectional view of toe tap 408-T including lower tap portion 416 and upper tap portion 418 mated with each other according to some examples of the disclosure. Fasteners 412 can penetrate upward through sole 404 and/or soundboard 414. Note that although FIG. 4C illustrates fasteners 412 penetrating upwards above the level of sole 404, their penetration above the sole is shown for purposes of clarifying the drawing, and may not be to scale. In practice, fasteners 412 may not penetrate above sole 404 for the comfort of the wearer, or may be covered or surrounded with other insole material so as not to cause discomfort to the wearer of the tap shoe 400. In the example of FIG. 4C, lower tap portion 416 and upper tap portion 418 may be made from metal such as aluminum or various aluminum alloys, steel or anodized forged steel, and others, though in other examples they may be made from other materials such as wood, plastic, fiberboard and the like. Aperture 450 can be formed in lower tap portion 416, and a corresponding aperture can also be formed in upper tap portion 418, both for receiving fastener 452.

Figure 4D:
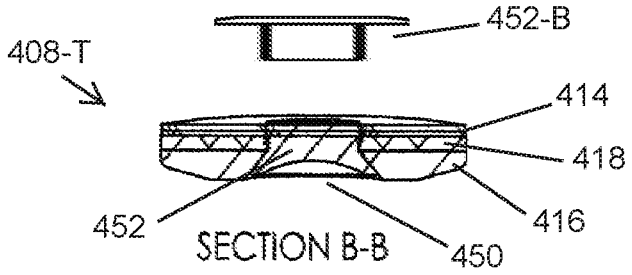
FIG. 4D illustrates a side cross-sectional view of a toe tap taken along the lines B-B in FIG. 4B according to some examples of the disclosure.

FIG. 4D illustrates a side cross-sectional view of toe tap 408-T taken along the lines B-B in FIG. 4B according to some examples of the disclosure. In the example of FIG. 4D, the head of fastener 452 is optionally concave, and is engaged with upper tap portion 418 through aperture 450 in lower tap portion 416 so as not to extend below the lower tap portion. In some examples, an aperture in upper tap portion 418 can have threaded walls for direct engagement with threads on fastener 452, providing a strong metal-to-metal threaded engagement to secure the upper tap portion and lower tap portion 416 in a manner that can be less likely to loosen or break. In other examples, the aperture in upper tap portion 418 can have smooth walls to enable screw post 452-B to pass through and engage with fastener 452 to provide the metal-to-metal threaded engagement to secure the upper tap portion and lower tap portion 416.

Figure 4E:
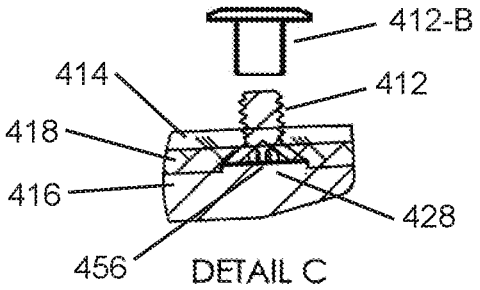
FIG. 4E illustrates a side cross-sectional view of Detail C shown in FIG. 4C according to some examples of the disclosure.

FIG. 4E illustrates a side cross-sectional view of Detail C shown in FIG. 4C according to some examples of the disclosure. In the example of FIG. 4E, fastener 412 is engaged with either one or both of soundboard 414 and sole (not shown in FIG. 4E) of tap shoe 400 through aperture 428 in upper tap portion 418. Note that although FIG. 4E illustrates fastener 412 penetrating upwards above the level of sole 404, their penetration above the sole is shown for purposes of clarifying the drawing, and may not be to scale. In some examples, fastener 412 can be threaded, and can engage with threads in either one or both of soundboard 414 and the sole of tap shoe 400. In other examples, screw post 412-B can pass through either or both of soundboard 414 or the sole of tap shoe 400 to provide a strong metal-to-metal connection with fastener 412 that can be less likely to loosen or break. In some examples, aperture 428 can include a countersunk area, and additionally raised area (e.g., a mesa, plateau and the like) 456 can be formed in lower tap portion 416 (or alternatively, separate raised area hardware can be attached to the lower tap portion), shaped to fit within the countersunk area of the aperture. When the lower tap portion 416 is aligned with upper tap portion 418, raised area 456 fits into the countersunk area of aperture 428 and makes contact with fastener 412 to prevent the fastener from partially/fully disengaging (e.g., backing out or loosening). In addition, this alignment can prevent the lower tap portion 416 from rotating with respect to upper tap portion 418.

Figure 4F:
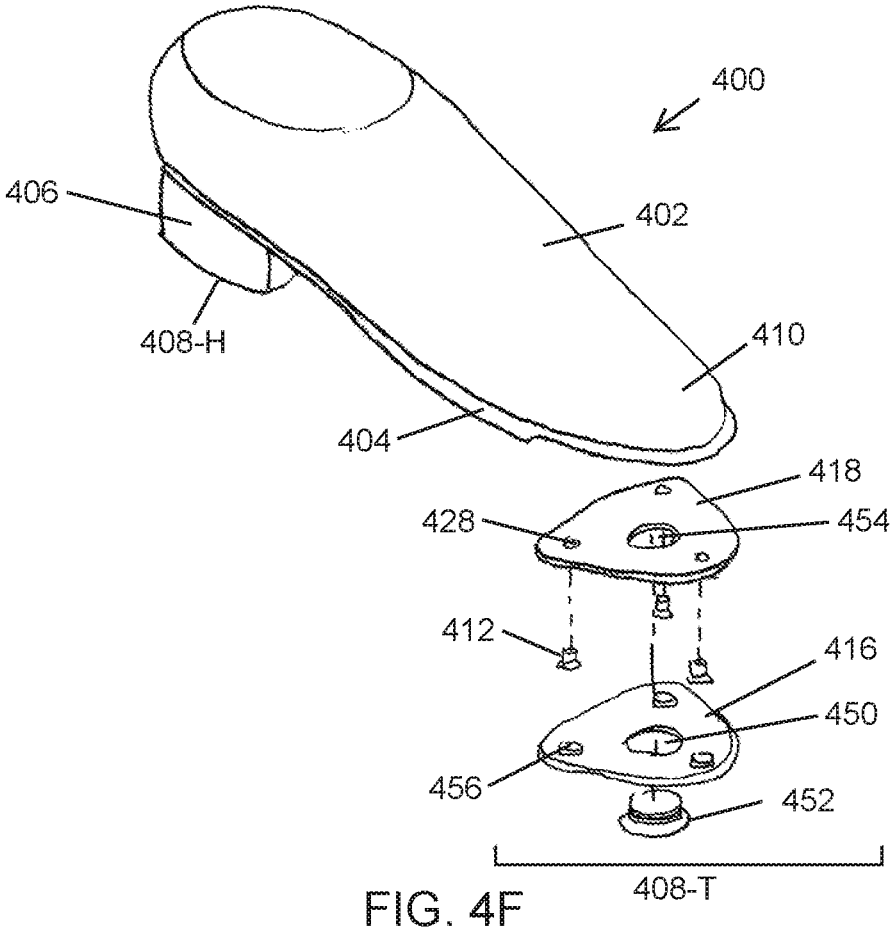
FIG. 4F illustrates a perspective top view of a tap shoe and an exploded perspective top view of a toe tap including an upper tap portion and a lower tap portion according to some examples of the disclosure.

FIG. 4F illustrates a perspective top view of tap shoe 400 and an exploded perspective top view of toe tap 408-T including upper tap portion 418 and lower tap portion 416 according to some examples of the disclosure. In the example of FIG. 4F, aperture 450 can be formed in lower tap portion 416 for receiving fastener 452. Raised areas 456 can be formed on the upper surface of lower tap portion 416 in alignment with apertures 428 in upper tap portion 418 to prevent fasteners 412 from partially or fully disengaging as mentioned above. FIG. 4F also shows an example arrangement of three apertures 428 in upper tap portion 418 for attaching the upper tap portion to the sole of the tap shoe and/or a soundboard (not shown in FIG. 4F) using fasteners 412, although it should be understood that different numbers of apertures, and different arrangements of apertures, may also be employed. Aperture 454 can also be formed in upper tap portion 418 for receiving fastener 452, and in some examples can be threaded to provide a direct metal-to-metal connection with the fastener. In other examples, aperture 454 can have smooth walls to enable a screw post (not shown in FIG. 4F) to pass through and engage with fastener 452 to provide the direct metal-to-metal connection. In some examples, fastener 452 can be a flat-head threaded screw as shown in FIG. 4B, although other types of screws or attachment hardware can also be employed. In some examples, fastener 452 can be a slotted screw, but in other examples the screw may be configured for other types of screw drives, such as Phillips, hex, and the like. In some examples, fastener 452 can be relatively large in diameter (as compared to fasteners 412, for example) to create additional circumferential surface area for increased frictional coupling of the fastener.

To install toe tap 408-T, upper tap portion 418 can first be affixed to either or both of soundboard (not shown in FIG. 4F) and sole 404, using fasteners 412 and/or compounds such as adhesives. Next, lower tap portion 416 can be aligned with upper tap portion 418. In examples with raised areas 456 and countersunk apertures 428, lower tap portion 416 can be aligned by positioning the lower tap portion such that the raised areas fit into the countersunk apertures. When lower tap portion 416 is aligned with upper tap portion 418, fastener 452 can be installed. In examples where fastener 452 is threaded, threads formed into the side walls of aperture 454 can engage with the threads of the fastener to secure the fastener. In contrast, in some examples the side walls of aperture 450 can be smooth to enable passage of fastener 452 without engagement with lower tap portion 416. When fastener 452 is installed, it can secure lower tap portion 416 against upper tap portion 418 to ensure that the lower tap portion does not disengage from the upper tap portion.

Although FIGS. 4A-4F and the accompanying text above illustrate and describe toe tap 408-T with a screw attachment mechanism, it should be understood that examples of the disclosure are equally applicable to heel tap 408-H. In some examples, the heel tap may be less pointed (more rounded), but the same features disclosed above can be applied to the heel tap as well.

Figure 5A:
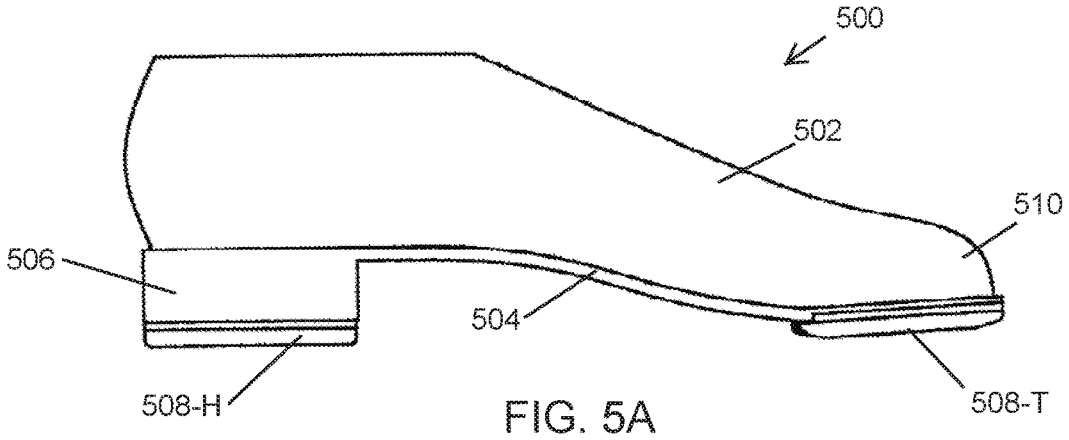
FIG. 5A illustrates a side view of a tap shoe employing a dovetail and screw attachment mechanism according to some examples of the disclosure.

FIG. 5A illustrates a side view of tap shoe 500 employing a dovetail and screw attachment mechanism according to some examples of the disclosure. Tap shoe 500 can include upper 502, which is often made of leather, sole 504, heel 506, and taps 508-H and 508-T attached to the heel and toe area. Some tap shoes 500 may contain toe box 510, which is a reinforced area around the toes.

Figure 5B:
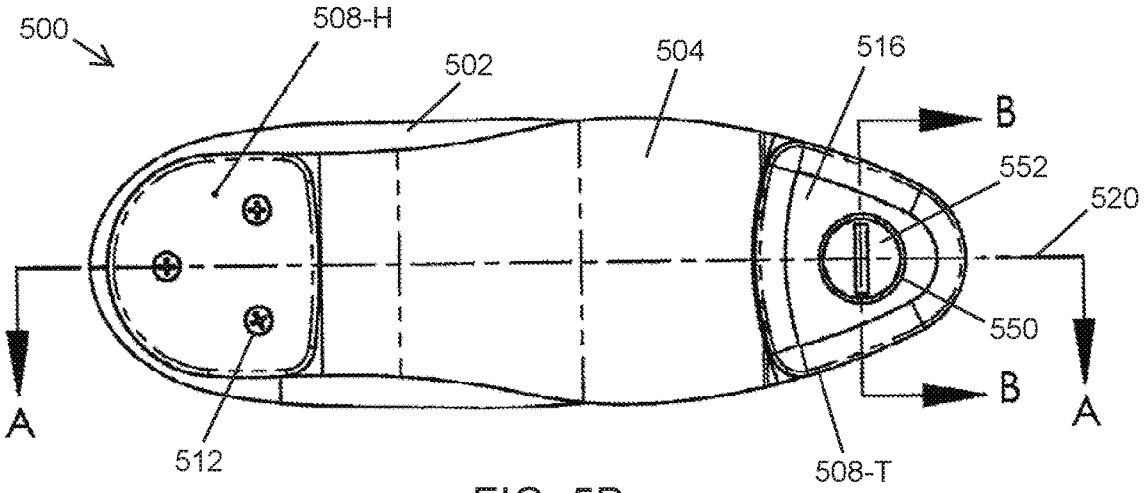
FIG. 5B illustrates a bottom view of a tap shoe according to some examples of the disclosure.

FIG. 5B illustrates a bottom view of tap shoe 500 according to some examples of the disclosure. In the example of FIG. 5B, heel tap 508-H may be made from aluminum or various aluminum alloys, steel or anodized forged steel, and others, and can be attached to the bottom of tap shoe 500 using fasteners (e.g., screws, screw/screw post combinations, threaded inserts, bolt/nut combinations, clevis pin/pin combinations, staples, nails, tacks, grommets, rivets and the like, and other hardware such as washers, lock washers, etc.) 512 through an optional intervening soundboard (not shown in FIG. 5B), and may also utilize various compounds such as adhesives. FIG. 5B also illustrates a bottom view of toe tap 508-T showing lower tap portion 516 longitudinally attached with respect to longitudinal axis 520 of the toe tap using a dovetail and screw attachment mechanism according to some examples of the disclosure. In the example of FIG. 5B, lower tap portion 516 is free of holes or other apertures for screws, screw/screw post combinations, threaded inserts, bolt/nut combinations, clevis pin/pin combinations, nails, tacks, staples, grommets, rivets or other attachment hardware, though an aperture 550 can be formed in lower tap portion 516 to receive fastener (e.g., screw, screw/screw post combination, and the like) 552. Although only one aperture 550 is shown in the example of FIG. 5B, in other examples a plurality of apertures may be employed. Although lower tap portion 516 is shown as being generally half-oval shaped, in other examples the lower tap portion can be formed into any shape appropriate for a tap shoe.

Figure 5C:
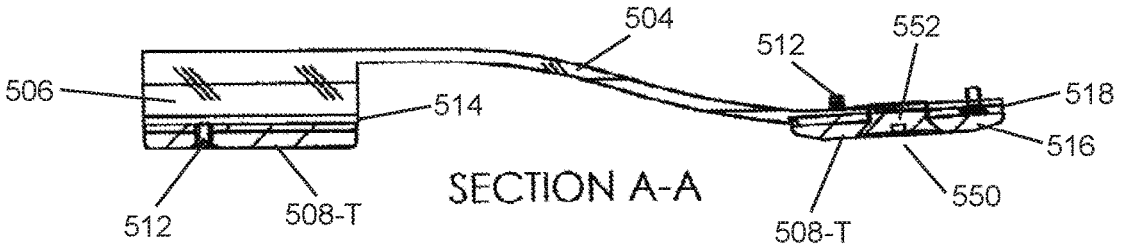
FIG. 5C illustrates a side cross-sectional view of the example tap shoe of FIG. 5B, taken along the lines A-A shown in FIG. 5B, according to some examples of the disclosure.

FIG. 5C illustrates a side cross-sectional view of example tap shoe 500 of FIG. 5B, taken along the lines A-A shown in FIG. 5B, according to some examples of the disclosure. FIG. 5C illustrates a side cross-sectional view of heel tap 508-H with fasteners 512 penetrating upward and being threaded through optional soundboard 514, which may be formed from fiberglass or other thin, lightweight material. Soundboard 514 can be attached to sole 504 and heel 506 of tap shoe 500 using fasteners such as screws, screw/screw post combinations, threaded inserts, bolt/nut combinations, clevis pin/pin combinations, nails, tacks, staples, grommets, rivets or other hardware such as washers, lock washers, etc., compounds such as adhesives, or a combination of these and other attachment means. FIG. 5C also illustrates a side cross-sectional view of toe tap 508-T including lower tap portion 516 and upper tap portion 518 mated with each other according to some examples of the disclosure. In the example of FIG. 5C, lower tap portion 516 and upper tap portion 518 may be made from metal such as aluminum or various aluminum alloys, steel or anodized forged steel, and others, though in other examples they may be made from other materials such as wood, plastic, fiberboard and the like. Aperture 550 can be formed in lower tap portion 516 to receive fastener 552, and a corresponding aperture can also be formed in upper tap portion 518.

Figure 5D:
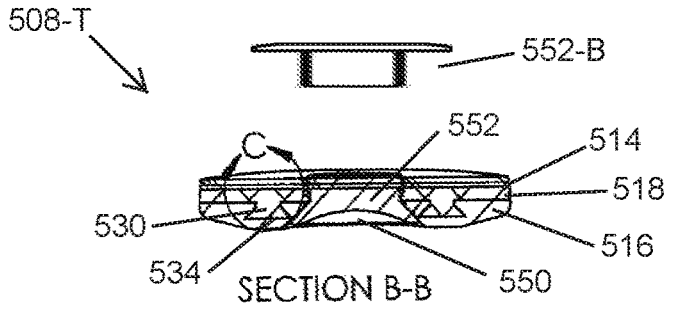
FIG. 5D illustrates a side cross-sectional view of a toe tap taken along the lines B-B in FIG. 5B according to some examples of the disclosure.

FIG. 5D illustrates a side cross-sectional view of toe tap 508-T taken along the lines B-B in FIG. 5B according to some examples of the disclosure. In the example of FIG. 5D, upper tap portion 518 can also include one or more projections (e.g., tenons, rails and the like) 530 extending downward from the upper tap portion. Lower tap portion 516 can also include one or more recesses (e.g., mortises, sockets, notches and the like) 534 for receiving projections 530. Although the projections 530 and recesses 534 shown in FIG. 5D are formed in "dovetail" shapes of tenons and mortises, in other examples different interlocking shapes may also be employed. In addition, although two dovetails are shown in FIG. 5D, in other examples different numbers of dovetails can be employed. In the example of FIG. 5D, the head of fastener 552 is optionally concave, and is engaged with upper tap portion 518 through aperture 550 in lower tap portion 516 so as not to extend below the lower tap portion. Furthermore, although the example of FIG. 5D shows projections 530 extending from upper tap portion 518 and recesses 534 formed in lower tap portion 516, in other examples the projections can extend from the lower tap portion and the recesses can be formed in upper tap portion. In other examples, each of upper tap portion 518 and lower tap portion 516 can contain both recesses 534 and projections 530.

In some examples, an aperture in upper tap portion 518 can have threaded walls for direct engagement with threads on fastener 552, providing a strong metal-to-metal threaded engagement to secure the upper tap portion and lower tap portion 516 in a manner that can be less likely to loosen or break. In other examples, the aperture in upper tap portion 518 can have smooth walls to enable screw post 552-B to pass through and engage with fastener 552 to provide the metal-to-metal threaded engagement to secure the upper tap portion and lower tap portion 516.

Figure 5E:
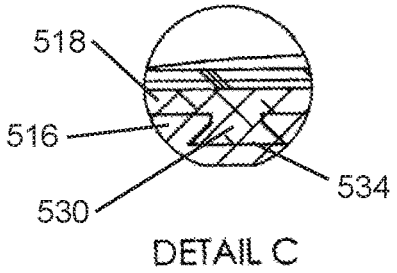
FIG. 5E illustrates a side cross-sectional view of Detail C shown in FIG. 5C according to some examples of the disclosure.

FIG. 5E illustrates a side cross-sectional view of Detail C shown in FIG. 5C according to some examples of the disclosure. In the example of FIG. 5E, upper tap portion 518 can also include one or more projections 530 extending downward from the upper tap portion. Lower tap portion 516 can also include one or more recesses 534 for receiving projections 530.

Figure 5F:
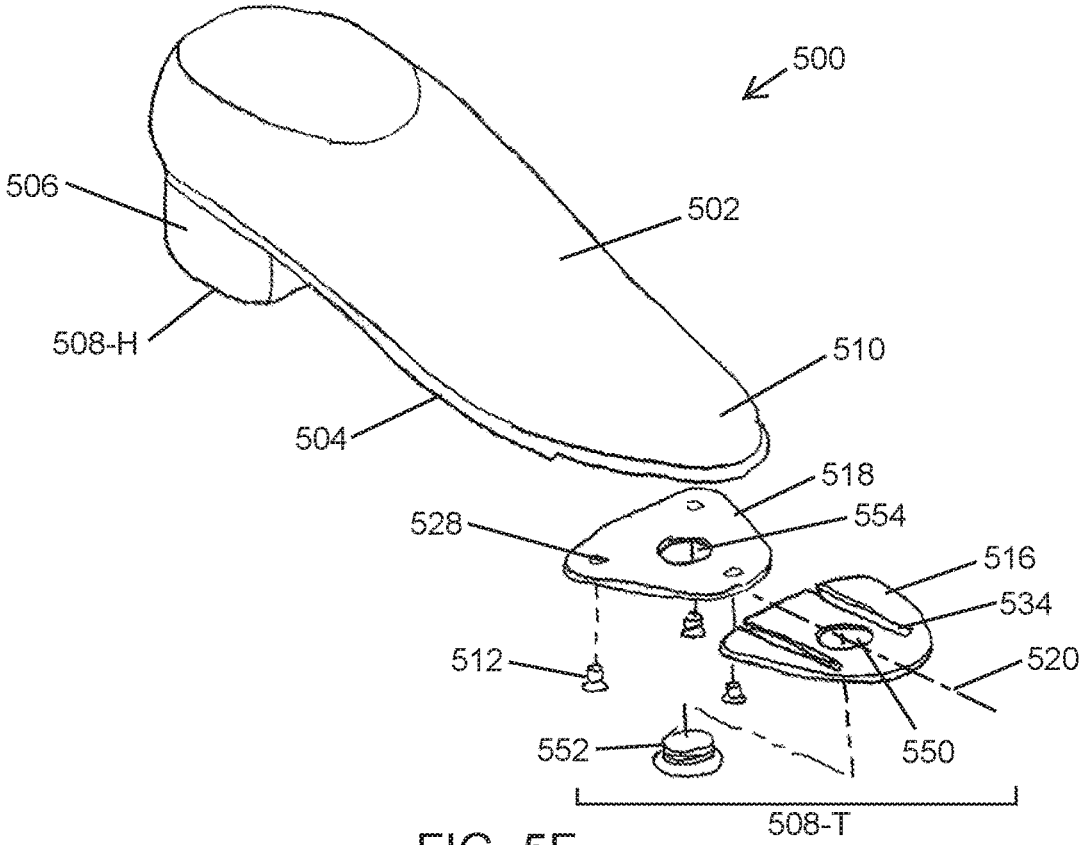
FIG. 5F illustrates a perspective top view of a tap shoe and an exploded perspective top view of a toe tap including an upper tap portion and a lower tap portion according to some examples of the disclosure.

FIG. 5F illustrates a perspective top view of tap shoe 500 and an exploded perspective top view of toe tap 508-T including upper tap portion 518 and lower tap portion 516 according to some examples of the disclosure. In the example of FIG. 5F, recesses 534 can be laterally formed in lower tap portion 516 parallel to longitudinal axis 520 of toe tap 508-T within the plane of the lower tap portion, although in other examples the recesses can be formed with other orientations with respect to the longitudinal axis. Although FIG. 5F illustrates recesses 534 open at only one longitudinal end, in other examples the recesses may be open at both ends. Aperture 550 can be formed in lower tap portion 516 for receiving fastener 552. Projections (not shown in FIG. 5F) can be laterally formed parallel to longitudinal axis 520 of toe tap 508-T in the underside of upper tap portion 518 in a plane parallel to the upper tap portion, although in other examples the projections can be formed with other orientations with respect to the longitudinal axis. FIG. 5F also shows an example arrangement of three apertures 528 in upper tap portion 518 for attaching the upper tap portion to the sole of the tap shoe and/or a soundboard (not shown in FIG. 5F) using fasteners 512, although it should be understood that different numbers of apertures, and different arrangements of apertures, may also be employed. Aperture 554 can also be formed in upper tap portion 518 for receiving fastener 552, and in some examples can be threaded to provide a direct metal-to-metal connection with the fastener. In other examples, aperture 554 can have smooth walls to enable a screw post (not shown in FIG. 5F) to pass through and engage with fastener 552 to provide the direct metal-to-metal connection. In some examples, fastener 552 can be a flat-head threaded screw as shown in FIG. 5B, although other types of screws or attachment hardware can also be employed, such as a screw post and screw arrangement, to name just one example. In some examples, fastener 552 can be a slotted screw, but in other examples the screw may employ other types of screw drives, such as Phillips, hex, and the like. In some examples, fastener 552 can be relatively large in diameter (as compared to fasteners 512, for example) to create additional circumferential surface area for increased frictional coupling of the fastener.

To install toe tap 508-T, upper tap portion 518 can first be affixed to sole 504, optionally through a soundboard (not shown in FIG. 5F), using fasteners 512 and/or compounds such as adhesives. In some examples, the top of upper tap portion 518 can be textured to provide a gripping surface for the adhesive. Next, lower tap portion 516 can be slid into upper tap portion 518 using recesses 534 and projections. The dovetail arrangement of FIG. 5F can be advantageous in that it can cover up fasteners 512 for the upper tap portion, which can protect the hardware and prevent it from breakage, loosening, and the like. When lower tap portion 516 is fully engaged with upper tap portion 518, apertures 550 and 554 should align, which can enable fastener 552 to be installed. In examples where fastener 552 is threaded, threads formed into the side walls of aperture 554 can engage with the threads of the fastener to secure the fastener. In contrast, in some examples the side walls of aperture 550 can be smooth to enable passage of fastener 552 without engagement with lower tap portion 516. When fastener 552 is installed, it can secure lower tap portion 516 and upper tap portion 518 to further ensure that the lower tap portion does not disengage from the upper tap portion.

Although FIGS. 5A-5F and the accompanying text above illustrate and describe toe tap 508-T with a dovetail and screw attachment mechanism, it should be understood that examples of the disclosure are equally applicable to heel tap 508-H. In some examples, the heel tap may be less pointed (more rounded), but the same features disclosed above can be applied to the heel tap as well.

It should be noted that in some examples, either or both of fasteners 552 and 552-B of FIGS. 5A-5F can also be employed with the taps of FIGS. 2A-2F and FIGS. 3A-3F.

Figure 6A:
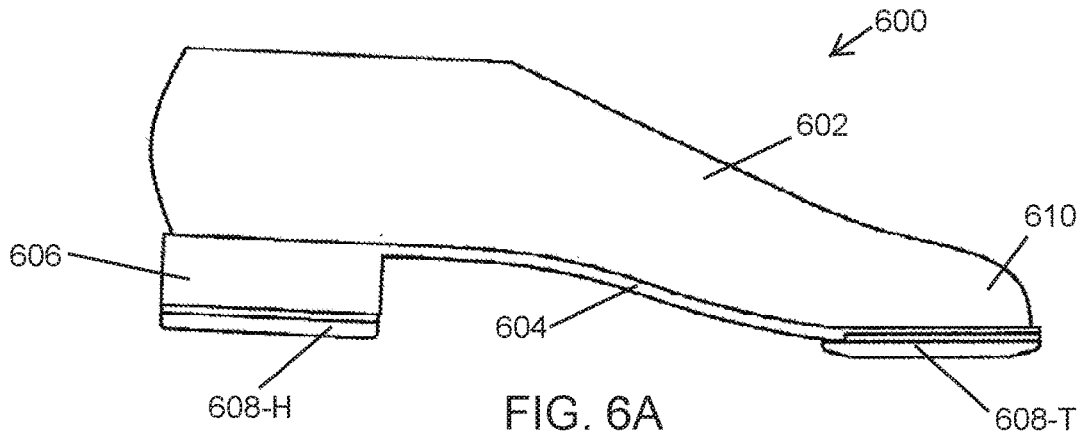
FIG. 6A illustrates a side view of a tap shoe employing a quarter-turn attachment plug according to some examples of the disclosure.

FIG. 6A illustrates a side view of tap shoe 600 employing a quarter-turn attachment plug according to some examples of the disclosure. Tap shoe 600 can include upper 602, which is often made of leather, sole 604, heel 606, and taps 608-H and 608-T attached to the heel and toe area. Some tap shoes 600 may contain toe box 610, which is a reinforced area around the toes.

Figure 6B:
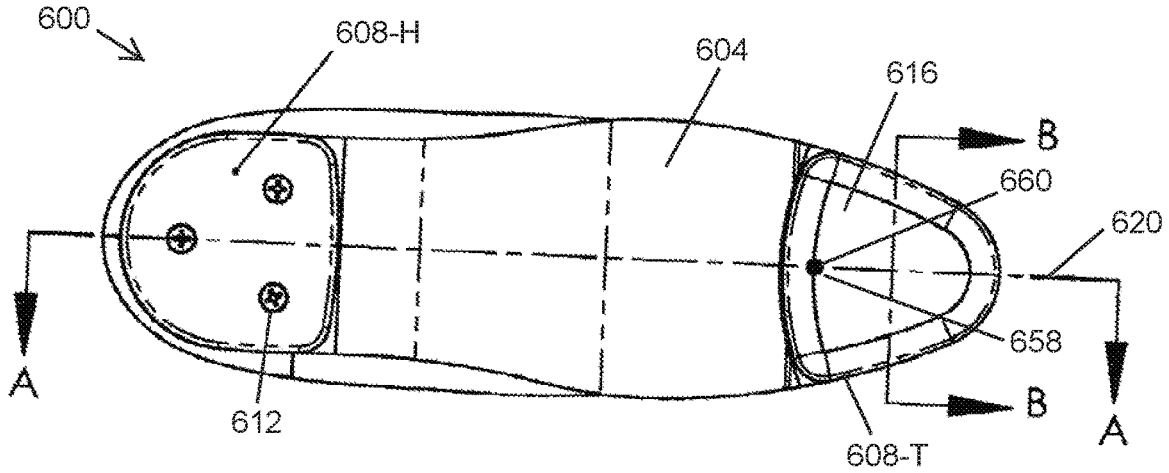
FIG. 6B illustrates a bottom view of a tap shoe according to some examples of the disclosure.

FIG. 6B illustrates a bottom view of tap shoe 600 according to some examples of the disclosure. In the example of FIG. 6B, heel tap 608-H may be made from aluminum or various aluminum alloys, steel or anodized forged steel, and others, and can be attached to the heel of tap shoe 600 using fasteners (e.g., screws, screw/screw post combinations, threaded inserts, bolt/nut combinations, clevis pin/pin combinations, nails, tacks, staples, grommets, rivets and the like, and other hardware such as washers, lock washers, etc.) 612 through an optional intervening soundboard (not shown in FIG. 6B), and may also utilize various compounds such as adhesives. FIG. 6B also illustrates a bottom view of toe tap 608-T showing lower tap portion 616 attached using a quarter-turn attachment plug (not shown in FIG. 6B) according to some examples of the disclosure. In the example of FIG. 6B, lower tap portion 616 is free of holes or other apertures for screws, screw/screw post combinations, threaded inserts, bolt/nut combinations, clevis pin/pin combinations, nails, tacks, staples, grommets, rivets or other attachment hardware, except that in some examples, aperture 658 can be formed in the lower tap portion to receive fastener (e.g., screws such as set screws, screw/screw post combinations, threaded inserts, bolt/nut combinations, clevis pin/pin combinations, nails, tacks, staples, grommets, rivets and the like) 660. Although lower tap portion 616 is shown as being generally half-oval shaped, in other examples the lower tap portion can be formed into any shape appropriate for a tap shoe.

Figure 6C:
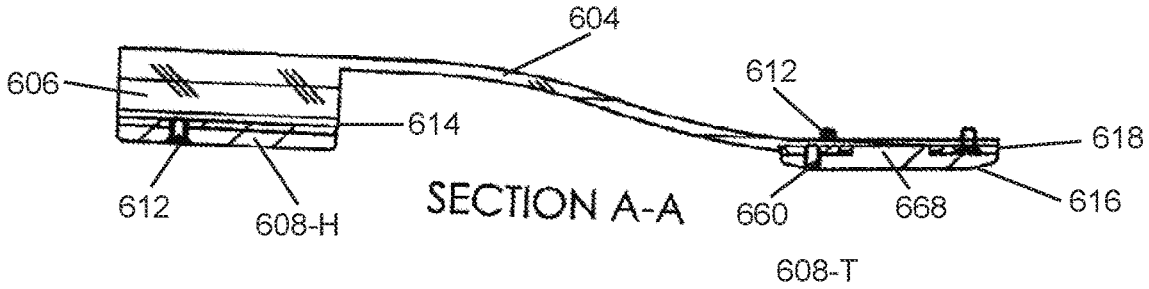
FIG. 6C illustrates a side cross-sectional view of the example tap shoe of FIG. 6B, taken along the lines A-A shown in FIG. 6B, according to some examples of the disclosure.

FIG. 6C illustrates a side cross-sectional view of example tap shoe 600 of FIG. 6B, taken along the lines A-A shown in FIG. 6B, according to some examples of the disclosure. In the example of FIG. 6C, heel tap 608-H can be secured to heel 606 using fasteners 612 that can be installed through apertures in the heel tap for engagement with either or both of soundboard 614 and heel 606. Soundboard 614 may be formed from fiberglass or other thin, lightweight material, and can be attached to heel 606 and/or sole 604 of tap shoe 600 using fasteners such as staples, screws, screw/screw post combinations, threaded inserts, bolt/nut combinations, clevis pin/pin combinations, nails, tacks, grommets, rivets or other hardware such as washers, lock washers, etc., compounds such as adhesives, or a combination of these and other attachment means.

FIG. 6C also illustrates a side cross-sectional view of toe tap 608-T including lower tap portion 616 and upper tap portion 618 mated with each other according to some examples of the disclosure. Fasteners 612 can penetrate upward through sole 604 and/or soundboard 614. Note that although FIG. 6C illustrates fasteners 612 penetrating upwards above the level of sole 604, their penetration above the sole is shown for purposes of clarifying the drawing, and may not be to scale. In practice, fasteners 612 may not penetrate above sole 604 for the comfort of the wearer, or may be covered or surrounded with other insole material so as not to cause discomfort to the wearer of the tap shoe 600. In some examples, fastener 660 can be installed through an aperture in lower tap portion 616 for engagement with upper tap portion 618 and/or a soundboard (not shown in FIG. 6C). In the example of FIG. 6C, lower tap portion 616 and upper tap portion 618 may be made from metal such as aluminum or various aluminum alloys, steel or anodized forged steel, and others, though in other examples they may be made from other materials such as wood, plastic, fiberboard and the like. Quarter-turn attachment plug 668 can be formed in lower tap portion 616.

Figure 6D:
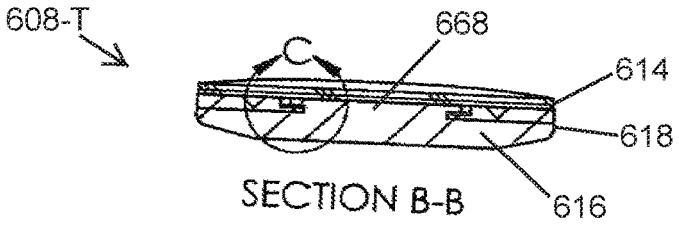
FIG. 6D illustrates a side cross-sectional view of a toe tap taken along the lines B-B in FIG. 6B according to some examples of the disclosure.

FIG. 6D illustrates a side cross-sectional view of toe tap 608-T taken along the lines B-B in FIG. 6B according to some examples of the disclosure. In the example of FIG. 6D, quarter-turn attachment plug 668 is engaged with upper tap portion 618 through an aperture in the upper tap portion. Although FIG. 6D shows a substantially solid lower tap portion 616 and upper tap portion 618, in other examples some areas of either or both of the upper and lower tap portions can be hollow to form one or more cavities between them when engaged.

Figure 6E:
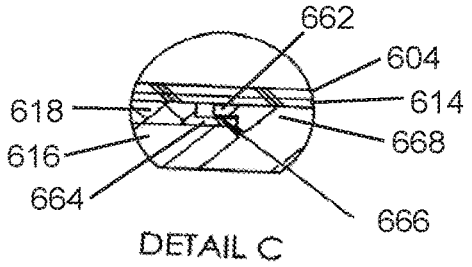
FIG. 6E illustrates a side cross-sectional view of Detail C shown in FIG. 6D according to some examples of the disclosure.

FIG. 6E illustrates a side cross-sectional view of Detail C shown in FIG. 6D according to some examples of the disclosure. In the example of FIG. 6E, quarter-turn attachment plug 668 includes tab 662 that can be engaged with a flange 664 formed in upper tap portion 618. Tab 662 can be sized with respect to flange 664 to create gap 666, even when the tab and flange are fully engaged. In some examples, tab 662 can be sized with respect to flange 664 (i.e., the height of gap 666 can be varied) to vary a "clap" sound of toe tap 608-T.

Figure 6F:
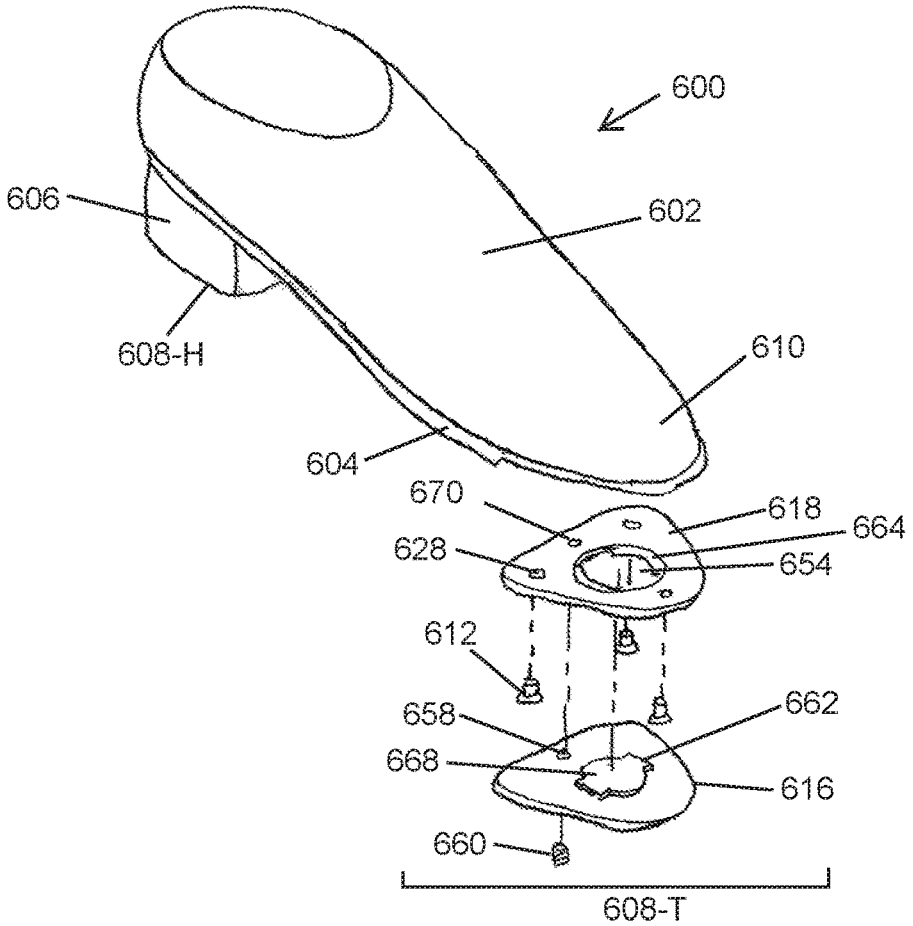
FIG. 6F illustrates a perspective top view of a tap shoe and an exploded perspective top view of a toe tap including an upper tap portion and a lower tap portion according to some examples of the disclosure.

FIG. 6F illustrates a perspective top view of tap shoe 600 and an exploded perspective top view of toe tap 608-T including upper tap portion 618 and lower tap portion 616 according to some examples of the disclosure. In the example of FIG. 6F, aperture 654 and flange 664 can be formed in upper tap portion 618 for receiving quarter-turn attachment plug 668 and tabs 662 according to some examples of the disclosure. FIG. 6F also shows an example arrangement of three apertures 628 in upper tap portion 618 for attaching the upper tap portion to the soundboard and/or sole of the tap shoe (not shown in FIG. 4F) using fasteners 612, although it should be understood that different numbers of apertures, and different arrangements of apertures, may also be employed. In some examples where cavities are formed between upper tap portion 618 and lower tap portion 616, the areas of the lower tap portion located underneath fasteners 612 can be free of cavities so that they can prevent the fasteners from disengaging (e.g., backing out or loosening). In some examples, quarter-turn attachment plug 668 can be relatively large in diameter (as compared to fasteners 612, for example) to create additional circumferential surface area for increased frictional coupling of the fastener. Although the example toe tap 608-T in FIG. 6F illustrates quarter-turn attachment plug 668 with two tabs 662 and upper tap portion 618 with two flanges 664, in other examples different numbers of tabs and flanges may be employed, and different amounts of rotation can be required to fully engage the upper and lower tap portions. In addition, although the example of FIG. 6F shows quarter-turn attachment plug 668 protruding upward from lower tap portion 616, and aperture 654 and flanges 664 formed in upper tap portion 618, in other examples the quarter-turn attachment plug can protrude downward from the upper tap portion, and the aperture and flanges can be formed in the lower tap portion.

To install toe tap 608-T, upper tap portion 618 can first be affixed to either or both of soundboard (not shown in FIG. 6F) and sole 604 using fasteners 612 and/or compounds such as adhesives. Next, tabs 662 on quarter-turn attachment plug 668 of lower tap portion 616 can be aligned with, and pushed through, the gaps between flanges 664 of upper tap portion 418. After alignment, lower tap portion 616 can be rotated with respect to upper tap portion 618 until the lower and upper tap portions are fully engaged. In this manner, lower tap portion 616 hides and protects fasteners 612 from exposure and possible loosening or breakage. In examples that include fastener 660, aperture 658 in lower tap portion 616 and aperture 670 in upper tap portion 618 can align, enabling the fastener to be engaged with either or both of apertures 658 and 670. In examples where fastener 660 is threaded, threads formed into the side walls of either or both of apertures 658 and 670 can engage with the threads of the fastener to secure the fastener. In contrast, in some examples the side walls of aperture 658 can be smooth to enable passage of fastener 660 without engagement with lower tap portion 616. When fastener 660 is installed, it can secure lower tap portion 616 against upper tap portion 618 to ensure that the lower tap portion does not rotate and disengage from the upper tap portion.

Although FIGS. 6A-6F and the accompanying text above illustrate and describe toe tap 608-T with a quarter-turn attachment plug, it should be understood that examples of the disclosure are equally applicable to heel tap 608-H. In some examples, the heel tap may be less pointed (more rounded), but the same features disclosed above can be applied to the heel tap as well.

Figure 7B:
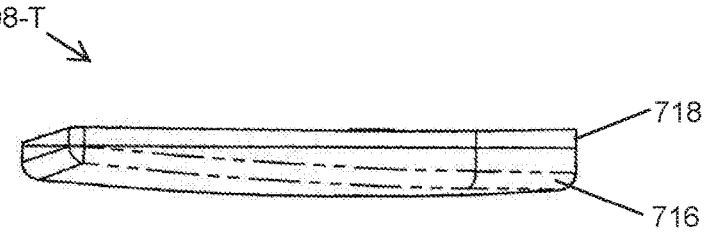
FIG. 7B illustrates a side view of a toe tap showing a lower tap portion and an upper tap portion adjacent to each other according to some examples of the disclosure.
Figure 7C:
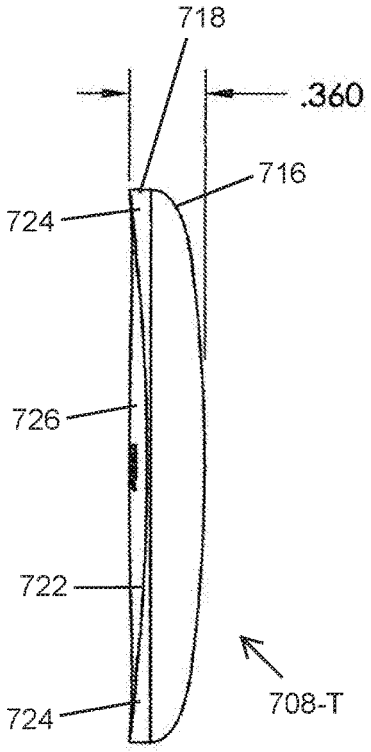
FIG. 7C illustrates a back view of a toe tap showing a lower tap portion and an upper tap portion according to some examples of the disclosure.
Figure 7A:
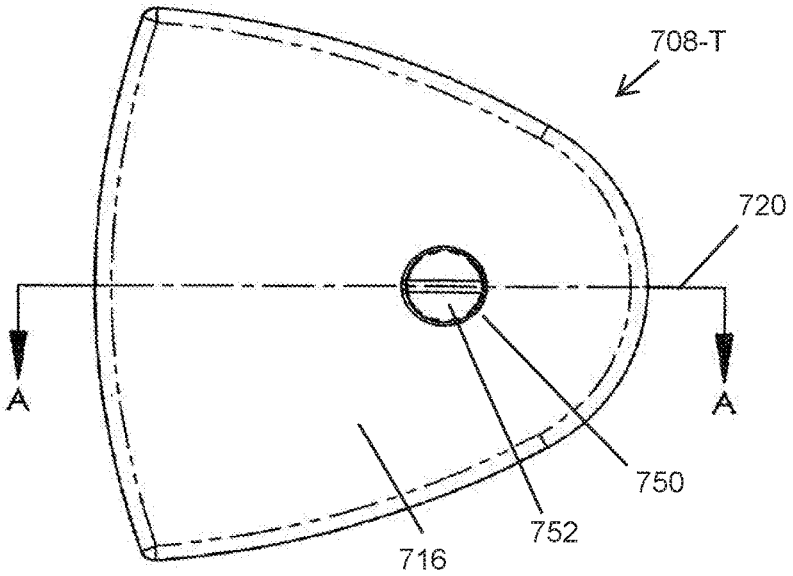
FIG. 7A illustrates a bottom orthographic view of a toe tap showing a lower tap portion including an aperture aligned along a longitudinal axis of the toe tap for receiving a fastener according to some examples of the disclosure.

FIG. 7A illustrates a bottom orthographic view of toe tap 708-T showing lower tap portion 716 including aperture 750 aligned along longitudinal axis 720 of the toe tap for receiving fastener (e.g., screw, screw/screw post combination, threaded insert and the like) 752 according to some examples of the disclosure, although in other examples a plurality of apertures and fasteners may be employed. Although lower tap portion 716 is shown as being generally half-oval shaped, in other examples the lower tap portion can be formed into any shape appropriate for a tap shoe.

FIG. 7B illustrates a side view of toe tap 708-T showing lower tap portion 716 and upper tap portion 718 adjacent to each other according to some examples of the disclosure. In the example of FIG. 7B, lower tap portion 716 and upper tap portion 718 may be made from metal such as aluminum or various aluminum alloys, steel or anodized forged steel, and others, though in other examples they may be made from other materials such as wood, plastic, fiberboard and the like.

FIG. 7C illustrates a back view of toe tap 708-T showing lower tap portion 716 and upper tap portion 718 according to some examples of the disclosure. In the example of FIG. 7C, upper tap portion 718 can be slightly concave at the rear (see reference number 722 in FIG. 7C), gradually thickening toward side edges 724, although in other examples the upper tap portion need not be concave. These thicker edges can result in a cavity 726 being formed between upper tap portion 718 and a soundboard or sole of the shoe (not shown in FIG. 7C), which can produce advantageous and desirable sound characteristics. In other examples, toe tap 708-T can be substantially solid and without cavities when upper tap portion 718 and lower tap portion 716 are engaged. Note that although FIG. 7C indicates a thickness of 0.360 inches for toe tap 708-T, it should be understood that this dimension is only an example, and that other thicknesses can be employed according to other examples of the disclosure.

Figure 7D:
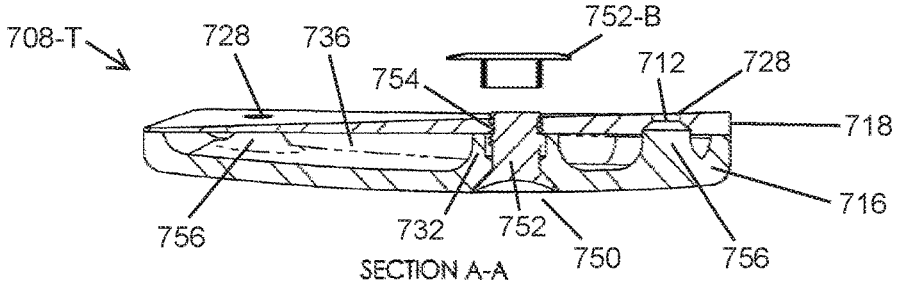
FIG. 7D illustrates a side cross-sectional view of a toe tap taken along the lines A-A in FIG. 7A according to some examples of the disclosure.

FIG. 7D illustrates a side cross-sectional view of toe tap 708-T taken along the lines A-A in FIG. 7A according to some examples of the disclosure. In the example of FIG. 7D, a plurality of apertures 728 can be formed in upper tap portion 718 for attaching the upper tap portion to either one or both of the soundboard and sole of the tap shoe (not shown in FIG. 7D) using fasteners (e.g., screws, screw/screw post combinations, threaded inserts, bolt/nut combinations, clevis pin/pin combinations, nails, tacks, staples, grommets, rivets and the like, and other hardware such as washers, lock washers, etc.) 712, although in some examples only one aperture 728 may be employed. In addition, an aperture 754 can be formed in upper tap portion 718 for receiving fastener 752. In some examples, aperture 754 can have threaded walls for direct engagement with threads on fastener 752, providing a strong metal-to-metal threaded engagement to secure upper tap portion 718 and lower tap portion 716 in a manner that can be less likely to loosen or break. In other examples, aperture 754 can have smooth walls to enable screw post 752-B to pass through and engage with fastener 752 to provide the metal-to-metal threaded engagement to secure upper tap portion 718 and lower tap portion 716. In other examples, fastener 752 can have one or more holes or depressions at its distal end for engagement with a pin (e.g., cotter pin, split pin, and the like) rather than a screw post. Lower tap portion 716 can also include one or more raised areas (e.g., mesas, plateaus and the like) 732 containing one or more apertures 750 for receiving fastener 752. Toe tap 708-T can also contain one or more cavities 736 formed between lower tap portion 716 and upper tap portion 718, which can produce advantageous and desirable sound characteristics. In some examples, loose material can additionally be placed in one or more cavities 736 to produce distinctive sounds. In addition, one or more raised areas 756 (e.g., mesas, plateaus and the like) can be formed in lower tap portion 716 (or alternatively, separate raised area hardware can be attached to the lower tap portion), located to align with apertures 728 in upper tap portion 718. When lower tap portion 716 is aligned with upper tap portion 718 such that raised areas 756 partially extend into apertures 728, raised areas 756 can make contact with fasteners 712 to prevent the fastener from partially/fully disengaging (e.g., backing out or loosening), and can prevent lower tap portion 716 from rotating with respect to upper tap portion 718 about an axis centered at fastener 752.

Figure 7E:
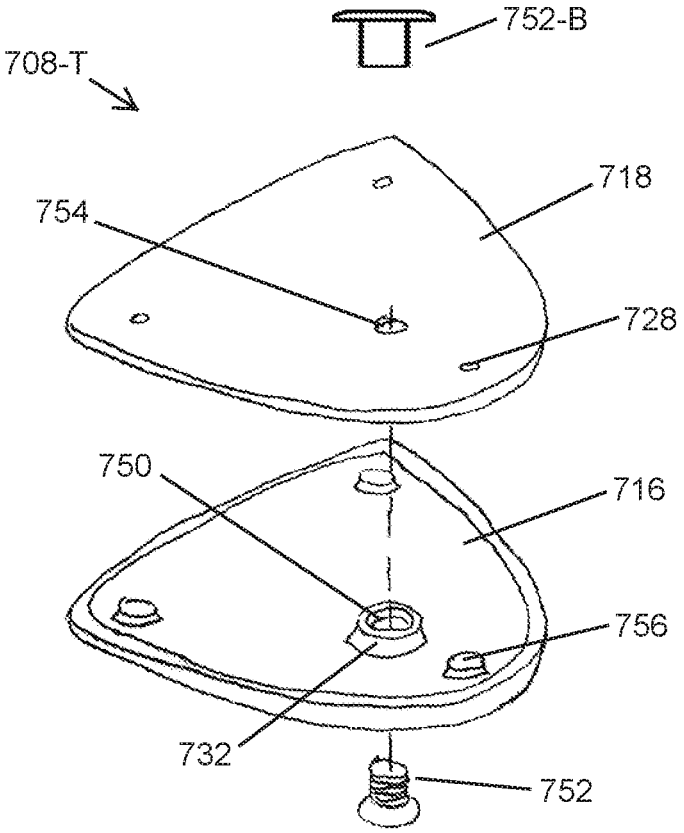
FIG. 7E illustrates exploded perspective top views of an upper tap portion and a lower tap portion according to examples of the disclosure.

FIG. 7E illustrates exploded perspective top views of upper tap portion 718 and lower tap portion 716 according to some examples of the disclosure. In the example of FIG. 7E, an example arrangement of three apertures (e.g., holes) 728 in upper tap portion 718 can be formed for attaching the upper tap portion to either or both of the soundboard and sole of the tap shoe (not shown in FIG. 7E) using fasteners such as screws, screw/screw post combinations, threaded inserts, bolt/nut combinations, clevis pin/pin combinations, tacks, staples, grommets, rivets, nails, and the like (not shown in FIG. 7E), although it should be understood that different numbers of apertures, and different arrangements of apertures, may also be employed. In addition, one or more raised areas 756 can be formed in lower tap portion 716 in alignment with apertures 728. The arrangement of FIG. 7E can be advantageous in that it can cover up attachment hardware for the upper tap portion, which can protect the hardware and prevent it from breakage, loosening, and the like, and can be advantageous because lower tap portion 716 may be secured with a metal-to-metal joint that may be less likely to break or loosen over time.

To install toe tap 708-T in examples where aperture 754 in upper tap portion 718 is threaded, upper tap portion 718 can be affixed to the soundboard or the sole of the tap shoe using one or more fasteners (e.g., screws, screw/screw post combinations, threaded inserts, bolt/nut combinations, clevis pin/pin combinations, nails, tacks, staples, grommets, rivets, or the like, and other hardware such as washers, lock washers, etc.) and/or compounds such as adhesives. Lower tap portion 716 can then be aligned with upper tap portion 718 such that raised areas 756 partially extend into apertures 728. Fastener 752 can then be inserted through aperture 750 in lower tap portion 716 and threaded into threaded aperture 754 of upper tap portion 718. In this manner, a metal-to-metal threaded connection can be formed to prevent fastener 752 from breaking or partially/fully disengaging (e.g., backing out or loosening).

To install toe tap 708-T in examples where screw post 752-B is employed, screw post 752-B can first be installed downward through aperture 754 of upper tap portion 718. Upper tap portion 718 can then be affixed to the soundboard or sole of the tap shoe using one or more fasteners (e.g., screws, screw/screw post combinations, threaded inserts, bolt/nut combinations, clevis pin/pin combinations, nails, tacks, staples, grommets, rivets, or the like, and other hardware such as washers, lock washers, etc.) and/or compounds such as adhesives. Fastener 752 can then be inserted through aperture 750 in lower tap portion 716 and threaded into screw post 752-B. In this manner, a metal-to-metal threaded connection can be formed to prevent fastener 752 from breaking or partially/fully disengaging (e.g., backing out or loosening). In addition, because the enlarged head of screw post 752-B is engaged with upper tap portion 718, it is very unlikely to pull through the upper tap portion.

Figure 7F:
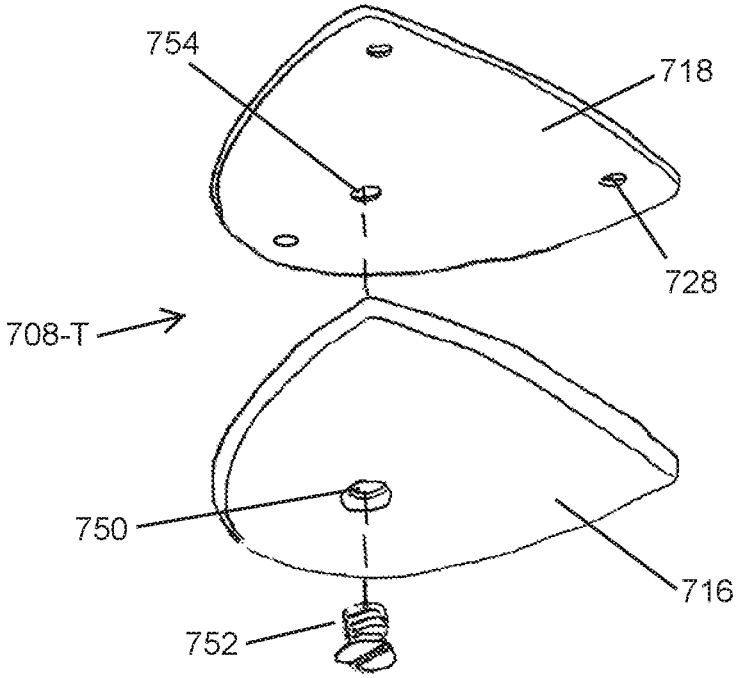
FIG. 7F illustrates an exploded perspective bottom view of an upper tap portion and a lower tap portion according to some examples of the disclosure.

FIG. 7F illustrates an exploded perspective bottom view of upper tap portion 718 and lower tap portion 716 according to some examples of the disclosure. In the example of FIG. 7F, fastener 752 is shown in alignment with aperture 750 in lower tap portion 716 and aperture 754 in upper tap portion 718.

Although FIGS. 7A-7F and the accompanying text above illustrate and describe toe tap 708-T, it should be understood that some examples of the disclosure are also applicable to a heel tap. In some examples, the heel tap may be less pointed (more rounded), but at least some of the same features disclosed above can be applied to the heel tap as well.

Figure 8B:
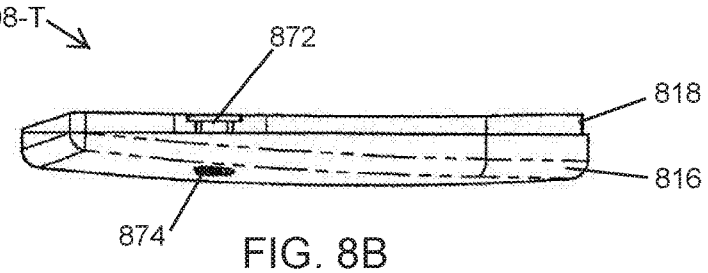
FIG. 8B illustrates a side view of a toe tap showing a lower tap portion and an upper tap portion adjacent to each other according to some examples of the disclosure.
Figure 8C:
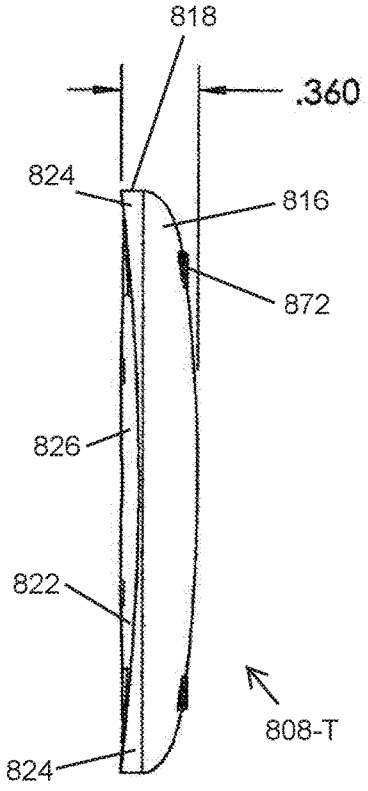
FIG. 8C illustrates a back view of a toe tap showing a lower tap portion and an upper tap portion according to some examples of the disclosure.
Figure 8A:
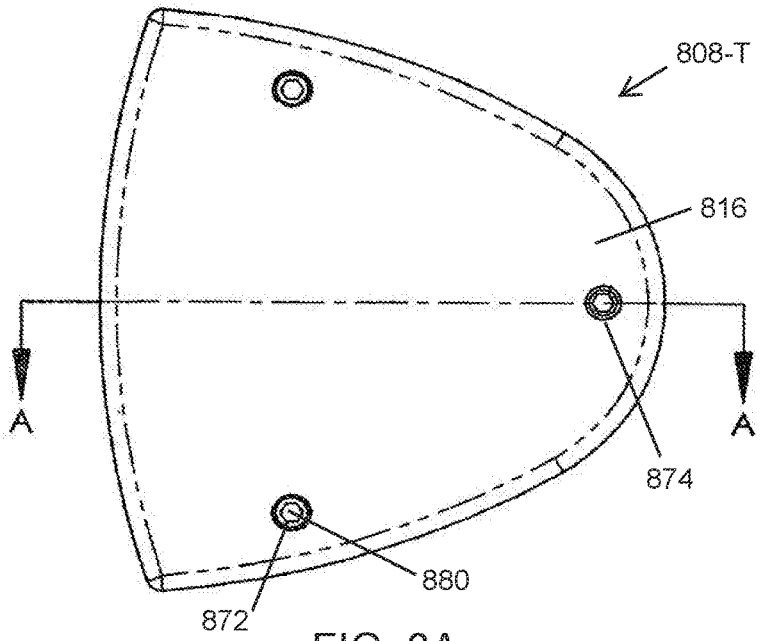
FIG. 8A illustrates a bottom orthographic view of a toe tap showing an lower tap portion including a plurality of apertures for receiving a plurality of fasteners according to some examples of the disclosure.

FIG. 8A illustrates a bottom orthographic view of toe tap 808-T showing lower tap portion 816 including a plurality of apertures 874 for receiving a plurality of fasteners (e.g., screws) 872 according to some examples of the disclosure, although in other examples a single aperture and fastener may be employed. Although lower tap portion 816 is shown as being generally half-oval shaped, in other examples the lower tap portion can be formed into any shape appropriate for a tap shoe.

FIG. 8B illustrates a side view of toe tap 808-T showing lower tap portion 816 and upper tap portion 818 adjacent to each other according to some examples of the disclosure. In the example of FIG. 8B, lower tap portion 816 and upper tap portion 818 may be made from metal such as aluminum or various aluminum alloys, steel or anodized forged steel, and others, though in other examples they may be made from other materials such as wood, plastic, fiberboard and the like. A portion of fastener 872 is shown in FIG. 8B, and the bottom end of the fastener can be retained within aperture 874 formed in lower tap portion 816.

FIG. 8C illustrates a back view of toe tap 808-T showing lower tap portion 816 and upper tap portion 818 according to some examples of the disclosure. In the example of FIG. 8C, upper tap portion 818 can be slightly concave at the rear (see reference number 822 in FIG. 8C), gradually thickening toward side edges 824, although in other examples the upper tap portion need not be concave. These thicker edges can result in a cavity 826 being formed between upper tap portion 818 and a soundboard or sole of the shoe (not shown in FIG. 8C), which can produce advantageous and desirable sound characteristics. The bottom end of fastener 872 is shown emerging from apertures in lower tap portion 816. Note that although FIG. 8C indicates a thickness of 0.360 inches for toe tap 808-T, it should be understood that this dimension is only an example, and that other thicknesses can be employed according to other examples of the disclosure.

Figure 8D:
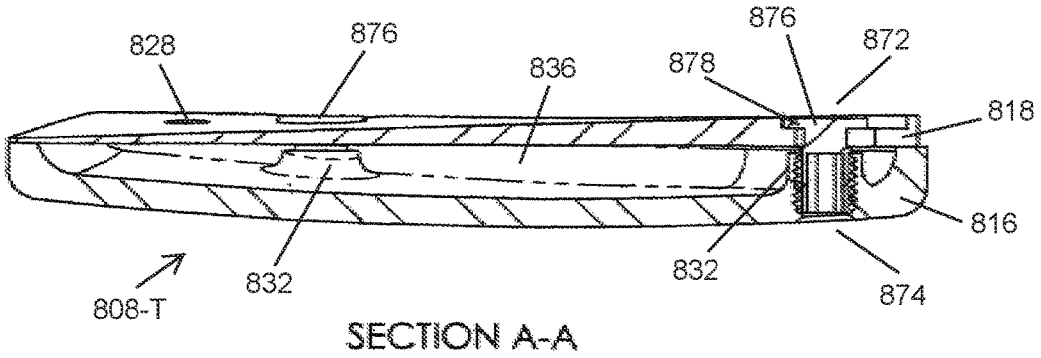
FIG. 8D illustrates a side cross-sectional view of a toe tap taken along the lines A-A in FIG. 8A according to some examples of the disclosure.

FIG. 8D illustrates a side cross-sectional view of toe tap 808-T taken along the lines A-A in FIG. 8A according to some examples of the disclosure. In the example of FIG. 8D, aperture 828 can be formed in upper tap portion 818 for attaching the upper tap portion to either one or both of the soundboard and sole of the tap shoe (not shown in FIG. 8D) using fasteners (e.g., screws, screw/screw post combinations, threaded inserts, bolt/nut combinations, clevis pin/pin combinations, nails, tacks, staples, grommets, rivets and the like, and other hardware such as washers, lock washers, etc.) (not shown in FIG. 8D). In addition, a plurality of apertures (e.g., notches) 876 can be formed in upper tap portion 818 for receiving fasteners 872. In some examples, apertures 876 can have one or more recessed ledges 878 for supporting fastener 872. In other words, the head of fastener 872 can rest (i.e., float) on ledge 878, and rotate on the ledge without threadably engaging with the ledge or upper tap portion 818. Lower tap portion 816 can also include one or more raised areas (e.g., mesas, plateaus and the like) 832 containing one or more apertures 874 for receiving fastener 872. In some examples, apertures 874 can be threaded for engaging with threaded end of fastener 872. Toe tap 808-T can also contain one or more cavities 836 formed between lower tap portion 816 and upper tap portion 818, which can produce advantageous and desirable sound characteristics. In some examples, loose material can additionally be placed in one or more cavities 836 to produce distinctive sounds. In other examples, toe tap 808-T can be substantially solid and without cavities when upper tap portion 818 and lower tap portion 816 are engaged.

Figure 8E:
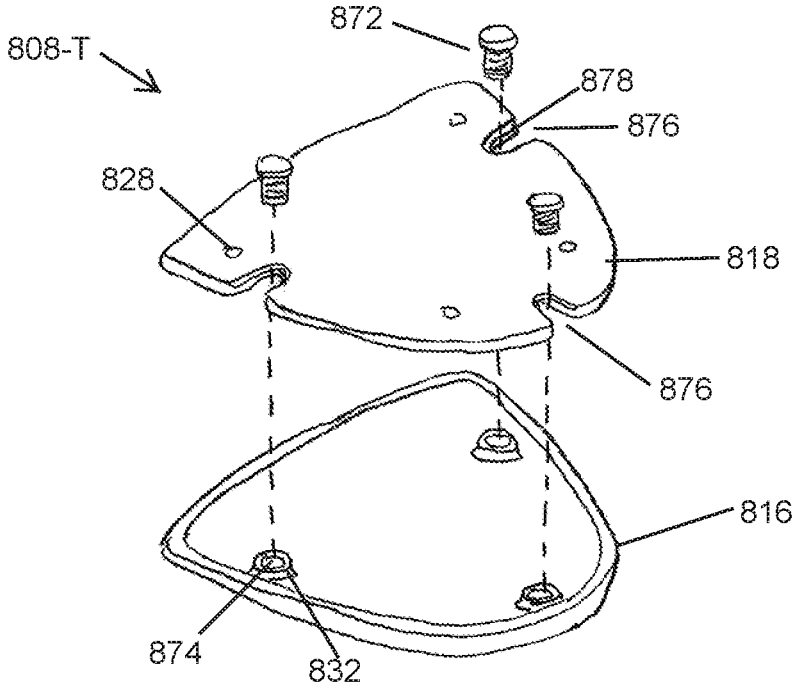
FIG. 8E illustrates exploded perspective top views of an upper tap portion and a lower tap portion according to some examples of the disclosure.

FIG. 8E illustrates exploded perspective top views of upper tap portion 818 and lower tap portion 816 according to some examples of the disclosure. In the example of FIG. 8E, an arrangement of four apertures (e.g., holes) 828 in upper tap portion 818 can be formed for attaching the upper tap portion to either or both of the soundboard and sole of the tap shoe (not shown in FIG. 8E) using fasteners such as screws, screw/screw post combinations, threaded inserts, bolt/nut combinations, clevis pin/pin combinations, tacks, staples, grommets, rivets, nails, and the like, although it should be understood that different numbers of apertures, and different arrangements of apertures, may also be employed. Raised areas (not shown in FIG. 8E) can be formed on the upper surface of lower tap portion 816 in alignment with apertures 828 in upper tap portion 818 to prevent fasteners within the apertures from partially/fully disengaging (e.g., backing out or loosening). In the example of FIG. 8E, an arrangement of three open apertures 876 (i.e., notches) can also be formed for rotatably engaging with fasteners 872, although in other examples a different number of apertures can be used, and closed apertures such as holes may also be employed. In addition, three raised areas 832 containing apertures 874 can be formed in lower tap portion 816 in alignment with apertures 876, although in other examples a different number of raised areas can be employed. The arrangement of FIG. 8E can be advantageous in that it can cover up attachment hardware for the upper tap portion, which can protect the hardware and prevent it from breakage, loosening, and the like, and can be advantageous because lower tap portion 816 may only be secured with a metal-to-metal joint that may be less likely to break or loosen over time.

To install toe tap 808-T, fasteners 872 can first be installed downward through aperture 876 of upper tap portion 818. Upper tap portion 818 can then be affixed to the soundboard or sole of the tap shoe using one or more fasteners (e.g., screws, screw/screw post combinations, threaded inserts, bolt/nut combinations, clevis pin/pin combinations, nails, tacks, staples, grommets, rivets, or the like, and other hardware such as washers, lock washers, etc.) and/or compounds such as adhesives. Apertures 874 of lower tap portion 816 can then be aligned with fasteners 872. Referring back to FIG. 8A, recess (e.g., Allen wrench hexagonal recess, slotted recess, Phillips recess, and the like) 880 at the distal end of fastener 872 can then be accessed through apertures 874 using the appropriate tool. By turning fastener 872 using the tool, the fastener can rotatably engage with threaded aperture 874, causing lower tap portion 816 to pull up towards upper tap portion 818 until tight. In this manner, a metal-to-metal threaded connection can be formed to prevent fastener 972 from breaking or partially/fully disengaging (e.g., backing out or loosening). In addition, because the enlarged head of fastener 872 is engaged with upper tap portion 818, it is very unlikely to pull through the upper tap portion.

Figure 8F:
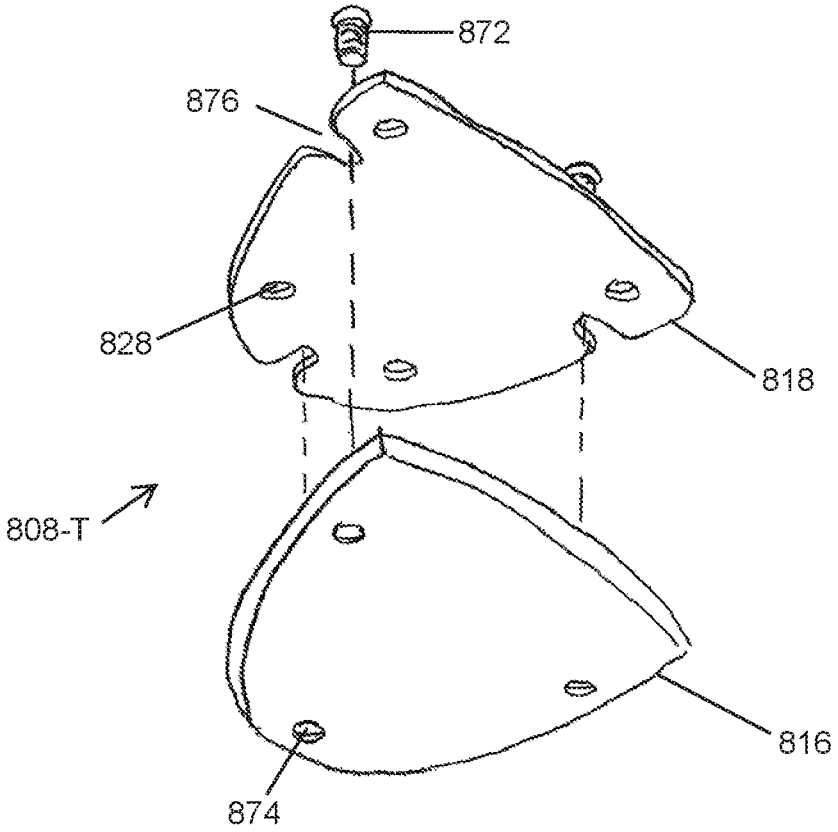
FIG. 8F illustrates an exploded perspective bottom view of an upper tap portion and a lower tap portion according to some examples of the disclosure.

FIG. 8F illustrates an exploded perspective bottom view of upper tap portion 818 and lower tap portion 816 according to some examples of the disclosure. In the example of FIG. 8F, fastener 872 is shown in alignment with aperture 876 in upper tap portion 818 and aperture 874 of lower tap portion 816.

Although FIGS. 8A-8F and the accompanying text above illustrate and describe toe tap 808-T, it should be understood that some examples of the disclosure are also applicable to a heel tap. In some examples, the heel tap may be less pointed (more rounded), but at least some of the same features disclosed above can be applied to the heel tap as well.

Figure 9B:
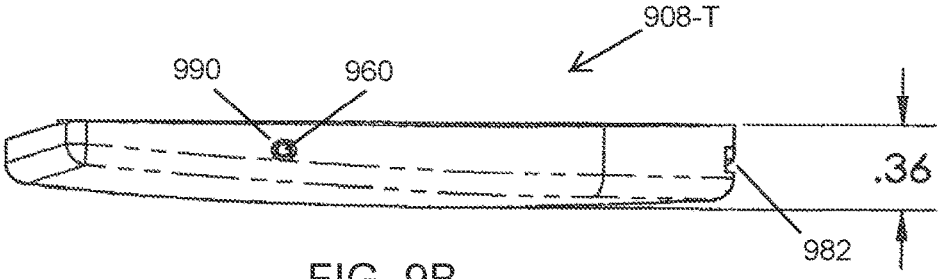
FIG. 9B illustrates a side view of a toe tap showing a lower tap portion according to some examples of the disclosure.
Figure 9A:
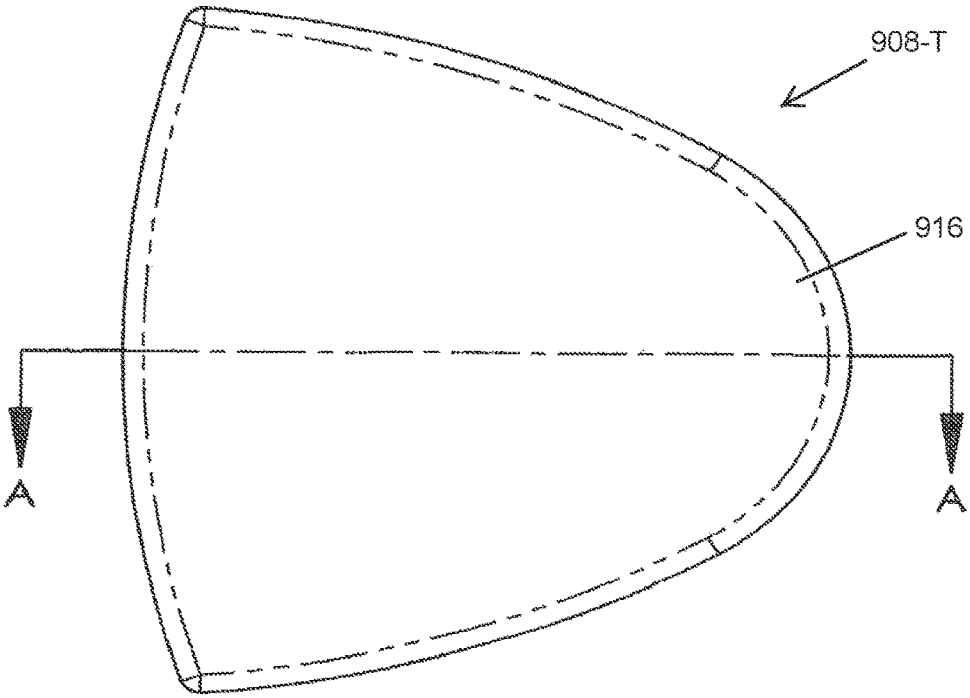
FIG. 9A illustrates a bottom orthographic view of a toe tap showing a lower tap portion according to some examples of the disclosure.

FIG. 9A illustrates a bottom orthographic view of toe tap 908-T showing lower tap portion 916 according to some examples of the disclosure. Although lower tap portion 916 is shown as being generally half-oval shaped, in other examples the lower tap portion can be formed into any shape appropriate for a tap shoe.

FIG. 9B illustrates a side view of toe tap 908-T showing lower tap portion 916, aperture 990, fastener (e.g., a screw such as a set screw, threaded insert, screw/screw post combination, grommet, rivet and the like) 960 located within aperture, and aperture 982, with an upper tap portion positioned within the lower tap portion (but hidden from view) and secured with the fastener and aperture according to some examples of the disclosure. Although only one aperture 990 and fastener 960 is shown in FIG. 9B, in other examples more than one aperture and fastener may be employed on each side of the toe tap 908-T. In the example of FIG. 9B, lower tap portion 916 and the upper tap portion may be made from metal such as aluminum or various aluminum alloys, steel or anodized forged steel, and others, though in other examples they may be made from other materials such as wood, plastic, fiberboard and the like.

Figure 9C:
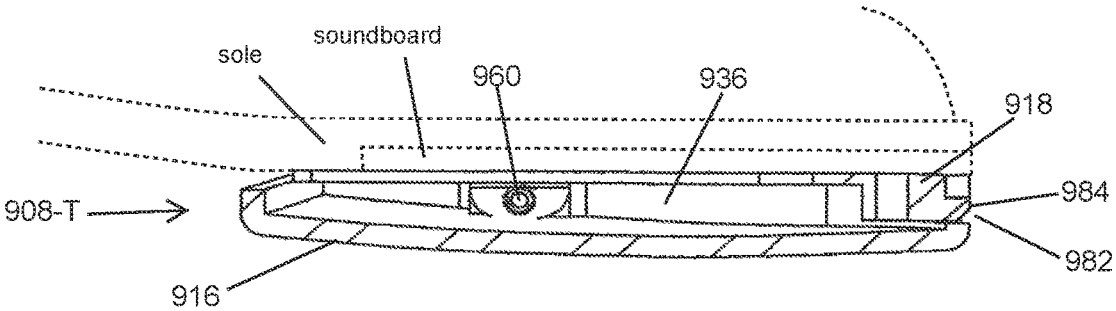
FIG. 9C illustrates a side cross-sectional view of a toe tap taken along the lines A-A in FIG. 9A according to some examples of the disclosure.

FIG. 9C illustrates a side cross-sectional view of toe tap 908-T taken along the lines A-A in FIG. 9A according to some examples of the disclosure. In the example of FIG. 9C, upper tap portion 918 can be positioned within lower tap portion 916, and in some examples the two portions can be pivotably coupled using fastener 960, although in other examples the two portions may not pivot with respect to each other, and more than one fastener may be employed. In addition, upper tap portion 918 can include a tab 984 which can be configured to be inserted and retained within aperture 982 in lower tap portion 916. Although only one tab 984 and aperture 982 are shown in FIG. 9C, in other examples more than one tab and aperture may be employed. One or more cavities 936 can be formed between lower tap portion 916 and upper tap portion 918, which can produce advantageous and desirable sound characteristics. In some examples, loose material can additionally be placed in one or more cavities 936 to produce distinctive sounds.

Figure 9D:
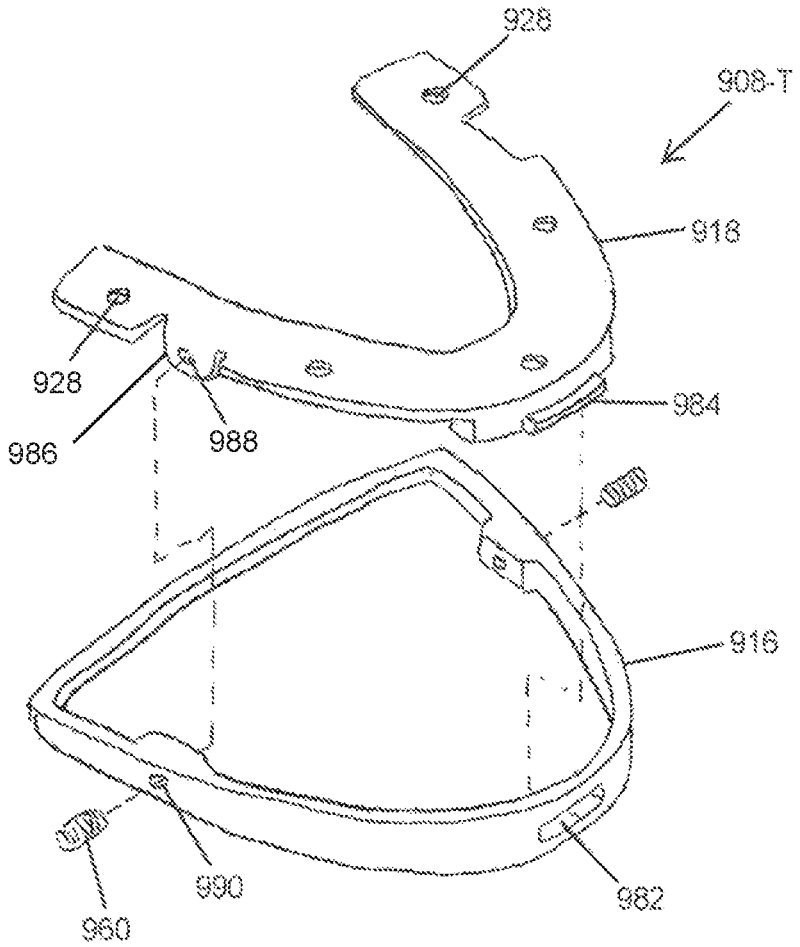
FIG. 9D illustrates exploded perspective top views of an upper tap portion and a lower tap portion according to examples of the disclosure.

FIG. 9D illustrates exploded perspective top views of upper tap portion 918 and lower tap portion 916 according to examples of the disclosure. Although the example of FIG. 9D shows upper tap portion 918 formed in a horseshoe shape, in other examples different shapes and configurations may also be employed. In the example of FIG. 9D, an arrangement of five apertures (e.g., holes) 928 in upper tap portion 918 can be formed for attaching the upper tap portion to either or both of the soundboard and sole of the tap shoe (not shown in FIG. 9D) using fasteners such as screws, screw/screw post combinations, threaded inserts, bolt/nut combinations, clevis pin/pin combinations, staples, grommets, rivets, nails, tacks and the like, although it should be understood that different numbers of apertures, and different arrangements of apertures, may also be employed. In some examples, raised areas (not shown in FIG. 9D) can be formed on the upper surface of lower tap portion 916 in alignment with apertures 928 in upper tap portion 918 to prevent fasteners within the apertures from partially/fully disengaging (e.g., backing out or loosening). In the example of FIG. 9D, an arrangement of two bent tabs 986 with apertures 988 can also be formed as part of upper tap portion 918 for engaging with fasteners 960, although in other examples different numbers or shapes of tabs, or separately formed tabs fixedly attached to the upper tap portion may also be employed. In addition, tab 984 can be formed in a front lip of upper tap portion 918 for engagement and retention within aperture 982 formed in a front lip of lower tap portion 916. Although FIG. 9D shows only one tab 984 and aperture 982, in other examples more than one tab and aperture pair may be employed. The dimensions of tab 984 and aperture 982 can vary, in some examples, to produce a certain amount of rotational motion of lower tap portion 916 with respect to upper tap portion 918 about a pivot point centered at the location of fastener 960. This rotational motion can advantageously produce a desirable tonal quality of toe tap 908-T. In other examples, there may be limited or no rotational motion between upper tap portion 918 and lower tap portion 916. Some examples may include more than one aperture 988 and bent tab 986 on each side of the toe tap 908-T. The arrangement of FIG. 9D can be advantageous in that it can cover up the fasteners that attach the upper tap portion to the tap shoe or soundboard, which can protect the hardware from breakage, loosening, and the like, and can be advantageous because lower tap portion 916 may be secured to upper tap portion 918 with fastener 960 that provides metal-to-metal connections that may be less likely to break or loosen over time.

To install toe tap 908-T, fasteners can first be utilized to attach upper tap portion 918 to either or both of the sole of the tap shoe and the soundboard, such that the upper tap portion makes direct contact with the sole and/or the soundboard. Lower tap portion 916 can then be oriented to engage aperture 982 with tab 984 on upper tap portion 918. Once engaged, the back end of lower tap portion 916 can be raised until upper tap portion 918 is seated within the lower tap portion, and apertures 988 and 990 are aligned. Fastener 960 can then be inserted into apertures 990 and 988 to couple lower tap portion 916 to upper tap portion 918. In some examples, fastener 960 is threaded, and either or both of apertures 990 and 988 are also threaded for threaded engagement with fastener 960. Fasteners 960 enable lower tap portion 916 to rotate slightly with respect to upper tap portion 918 to produce desirable tones.

Although FIGS. 9A-9D and the accompanying text above illustrate and describe toe tap 908-T, it should be understood that some examples of the disclosure are also applicable to a heel tap. In some examples, the heel tap may be less pointed (more rounded), but at least some of the same features disclosed above can be applied to the heel tap as well.

Therefore, according to the above, some examples of the disclosure are directed to a tap apparatus for attachment to a shoe, comprising: an upper tap portion; and at least one lateral projection or recess formed with the upper tap portion and configured for engagement with a lower tap portion. Alternatively or additionally to one or more of the examples disclosed above, in some examples the tap apparatus further comprises the lower tap portion; and at least one lateral recess or projection formed with the lower tap portion and configured for engagement with the upper tap portion. Alternatively or additionally to one or more of the examples disclosed above, in some examples the upper tap portion and lower tap portion are configured to form one or more cavities between the upper tap portion and the lower tap portion when the upper tap portion and the lower tap portion are engaged. Alternatively or additionally to one or more of the examples disclosed above, in some examples the tap apparatus further comprises one or more first fasteners configured for securing the upper tap portion to the lower tap portion. Alternatively or additionally to one or more of the examples disclosed above, in some examples one or more of the first fasteners comprises a set screw. Alternatively or additionally to one or more of the examples disclosed above, in some examples one or more of the first fasteners comprises a snap locking tab formed with the upper tap portion. Alternatively or additionally to one or more of the examples disclosed above, in some examples the tap apparatus further comprises an aperture formed in the lower tap portion for receiving the snap locking tab. Alternatively or additionally to one or more of the examples disclosed above, in some examples the tap apparatus further comprises one or more apertures formed in the upper tap portion and configured for enabling attachment of the upper tap portion to the shoe. Alternatively or additionally to one or more of the examples disclosed above, in some examples the tap apparatus further comprises one or more second fasteners configured for enabling attachment of the upper tap portion to the shoe.

Alternatively or additionally to one or more of the examples disclosed above, in some examples one or more of the second fasteners comprises a screw and screw post combination. Alternatively or additionally to one or more of the examples disclosed above, in some examples the tap apparatus further comprises the lower tap portion; and one or more raised areas formed with the lower tap portion and aligned with one or more of the second fasteners for preventing one or more of the second fasteners from disengaging. Alternatively or additionally to one or more of the examples disclosed above, in some examples the at least one lateral projection or recess is transversely formed with respect to a longitudinal axis of the tap apparatus.

Some examples of the disclosure are directed to a method for attaching a tap apparatus to a shoe, comprising: affixing an upper tap portion to the shoe using one or more fasteners; slidably engaging a lower tap portion with the upper tap portion; and covering the one or more fasteners when the lower tap portion is engaged with the upper tap portion. Alternatively or additionally to one or more of the examples disclosed above, in some examples the method further comprises forming one or more cavities between the lower tap portion and the upper tap portion. Alternatively or additionally to one or more of the examples disclosed above, in some examples the method further comprises forming at least one lateral projection or recess in each of the upper tap portion and the lower tap portion to facilitate the slidable engagement of the lower tap portion with the upper tap portion. Alternatively or additionally to one or more of the examples disclosed above, in some examples the method further comprises securing the lower tap portion to the upper tap portion using a fastener after the slidable engagement of the lower tap portion with the upper tap portion. Alternatively or additionally to one or more of the examples disclosed above, in some examples the method further comprises locking the lower tap portion to the upper tap portion using a snap locking tab. Alternatively or additionally to one or more of the examples disclosed above, in some examples the method further comprises preventing the one or more fasteners from disengaging by forming one or more raised areas in the lower tap portion in alignment with the one or more fasteners. Alternatively or additionally to one or more of the examples disclosed above, in some examples the method further comprises transversely forming the at least one lateral projection or recess with respect to a longitudinal axis of the tap apparatus. Alternatively or additionally to one or more of the examples disclosed above, in some examples the method further comprises longitudinally forming the at least one lateral projection or recess with respect to a longitudinal axis of the tap apparatus.

Some examples of the disclosure are directed to tap apparatus for attachment to a shoe, comprising: an upper tap portion having one or more first apertures configured for receiving one or more first fasteners and enabling attachment of the upper tap portion to the shoe; and a lower tap portion configured for covering the one or more first fasteners when the lower tap portion is threadably engaged with the upper tap portion. Alternatively or additionally to one or more of the examples disclosed above, in some examples the tap apparatus further comprises: a second aperture formed in the upper tap portion; a third aperture formed in the lower tap portion and configured for alignment with the second aperture; and a second fastener configured for being retained within the second and third apertures and securing the lower tap portion to the upper tap portion. Alternatively or additionally to one or more of the examples disclosed above, in some examples the second aperture and the second fastener are threaded for threaded engagement with each other. Alternatively or additionally to one or more of the examples disclosed above, in some examples the second fastener is a screw, the tap apparatus further comprising a screw post configured for being retained within the second aperture and for threaded engagement with the screw. Alternatively or additionally to one or more of the examples disclosed above, in some examples the third aperture is threaded; and the second fastener is a floating screw configured for threaded engagement with the third aperture. Alternatively or additionally to one or more of the examples disclosed above, in some examples the tap apparatus further comprises one or more cavities formed between the upper tap portion and the lower tap portion when the upper tap portion and the lower tap portion are rotatably engaged. Alternatively or additionally to one or more of the examples disclosed above, in some examples one or more of the first fasteners comprises a screw and screw post combination. Alternatively or additionally to one or more of the examples disclosed above, in some examples the tap apparatus further comprises: one or more raised areas formed with the lower tap portion and configured for alignment with one or more of the first fasteners for preventing one or more of the first fasteners from disengaging. Alternatively or additionally to one or more of the examples disclosed above, in some examples one or more of the first apertures includes a countersunk area configured for retaining at least a portion of one or more of the raised areas to prevent the lower tap portion from rotating with respect to the upper tap portion. Alternatively or additionally to one or more of the examples disclosed above, in some examples the tap apparatus further comprises at least one lateral projection or recess formed in each of the lower tap portion and the upper tap portion and configured for engagement of the lower tap portion and the upper tap portion. Alternatively or additionally to one or more of the examples disclosed above, in some examples the at least one lateral projection or recess is transversely formed with respect to a longitudinal axis of the tap apparatus. Alternatively or additionally to one or more of the examples disclosed above, in some examples the at least one lateral projection or recess is longitudinally formed with respect to a longitudinal axis of the tap apparatus.

Some examples of the disclosure are directed to a method for attaching a tap apparatus to a shoe, comprising: affixing an upper tap portion to the shoe using one or more first fasteners retained within one or more first apertures; threadably engaging the upper tap portion with a lower tap portion; and covering the one or more first fasteners when the lower tap portion is threadably engaged with the upper tap portion. Alternatively or additionally to one or more of the examples disclosed above, in some examples the method further comprises: aligning a second aperture in the upper tap portion and a third aperture in the lower tap portion; and engaging the upper tap portion with the lower tap portion using a second fastener retained within the second and third apertures. Alternatively or additionally to one or more of the examples disclosed above, in some examples the method further comprises threadably engaging the second aperture and the second fastener. Alternatively or additionally to one or more of the examples disclosed above, in some examples the second fastener is a screw, and the method further comprises threadably engaging the screw with a screw post retained within the second aperture. Alternatively or additionally to one or more of the examples disclosed above, in some examples the second fastener is a floating screw, the method further comprising threadably engaging the screw and the third aperture. Alternatively or additionally to one or more of the examples disclosed above, in some examples the method further comprises forming one or more cavities between the lower tap portion and the upper tap portion. Alternatively or additionally to one or more of the examples disclosed above, in some examples one or more of the first fasteners comprises a screw and screw post combination. Alternatively or additionally to one or more of the examples disclosed above, in some examples the method further comprises preventing one or more of the first fasteners from disengaging by forming one or more raised areas with the lower tap portion and aligning the one or more raised areas with one or more of the first fasteners.

Some examples of the disclosure are directed to a tap apparatus for attachment to a shoe, comprising: an upper tap portion having one or more first apertures configured for receiving one or more first fasteners and enabling attachment of the upper tap portion to the shoe; and a lower tap portion configured for covering the one or more first fasteners when the lower tap portion is rotatably engaged with the upper tap portion. Alternatively or additionally to one or more of the examples disclosed above, in some examples the tap apparatus further comprises: a second aperture formed in the upper tap portion; and a plug formed with the lower tap portion and configured for alignment with the second aperture; wherein the plug is configured for being retained within the second aperture and engaging the lower tap portion with the upper tap portion. Alternatively or additionally to one or more of the examples disclosed above, in some examples the tap apparatus further comprises: one or more tabs formed with the plug; and one or more flanges formed the second aperture; wherein the one or more tabs and the one or more flanges are configured for engagement with each other when the plug is inserted into the second aperture and rotated. Alternatively or additionally to one or more of the examples disclosed above, in some examples the one or more tabs and the one or more flanges are sized to create a gap between them when rotatably engaged and generate a sound quality dependent on a size of the gap. Alternatively or additionally to one or more of the examples disclosed above, in some examples the tap apparatus further comprises: one or more third apertures formed in the upper tap portion; one or more fourth apertures formed in the lower tap portion; and one or more second fasteners configured for being inserted into the one or more third apertures and the one or more fourth apertures to secure the lower tap portion to the upper tap portion when the lower tap portion is rotatably engaged with the upper tap portion. Alternatively or additionally to one or more of the examples disclosed above, in some examples one or more of the third apertures is threaded, and one or more of the second fasteners is a set-screw configured for threaded engagement with the one or more threaded third apertures. Alternatively or additionally to one or more of the examples disclosed above, in some examples the tap apparatus further comprises one or more cavities formed between the upper tap portion and the lower tap portion when the upper tap portion and the lower tap portion are rotatably engaged. Alternatively or additionally to one or more of the examples disclosed above, in some examples one or more of the first fasteners comprises a screw and screw post combination. Alternatively or additionally to one or more of the examples disclosed above, in some examples the tap apparatus further comprises: one or more areas formed with the lower tap portion and configured for alignment with one or more of the first fasteners for preventing one or more of the first fasteners from disengaging. Alternatively or additionally to one or more of the examples disclosed above, in some examples the tap apparatus further comprises: a second aperture formed in the lower tap portion; and a plug formed with the upper tap portion and configured for alignment with the second aperture; wherein the plug is configured for being retained within the second aperture and engaging the lower tap portion with the upper tap portion.

Some examples of the disclosure are directed to a method for attaching a tap apparatus to a shoe, comprising: affixing an upper tap portion to the shoe using one or more first fasteners retained within one or more first apertures; rotatably engaging the upper tap portion with a lower tap portion; and covering the one or more first fasteners when the lower tap portion is rotatably engaged with the upper tap portion. Alternatively or additionally to one or more of the examples disclosed above, in some examples the method further comprises aligning a second aperture formed in the upper tap portion and a plug formed with the lower tap portion; and retaining the plug within the second aperture and engaging the lower tap portion with the upper tap portion. Alternatively or additionally to one or more of the examples disclosed above, in some examples the method further comprises engaging the lower tap portion and upper tap portion using one or more tabs formed with the plug and one or more flanges formed in the second aperture when the plug is inserted into the second aperture and rotated. Alternatively or additionally to one or more of the examples disclosed above, in some examples the method further comprises sizing the one or more tabs and the one or more flanges to create a gap between them when rotatably engaged and generate a sound quality dependent on a size of the gap. Alternatively or additionally to one or more of the examples disclosed above, in some examples the method further comprises: after the lower tap portion is rotatably engaged with the upper tap portion, inserting one or more fasteners into one or more third apertures formed in the upper tap portion and one or more fourth apertures formed in the lower tap portion to secure the lower tap portion to the upper tap portion. Alternatively or additionally to one or more of the examples disclosed above, in some examples one or more of the third apertures is threaded and one or more of the second fasteners is a set-screw, the method further comprising threadably engaging one or more of the set-screws with the one or more threaded third apertures. Alternatively or additionally to one or more of the examples disclosed above, in some examples the method further comprises forming one or more cavities between the upper tap portion and the lower tap portion when the upper tap portion and the lower tap portion are rotatably engaged. Alternatively or additionally to one or more of the examples disclosed above, in some examples one or more of the first fasteners comprises a screw and screw post combination. Alternatively or additionally to one or more of the examples disclosed above, in some examples the method further comprises: forming one or more areas with the lower tap portion and aligning the one or more areas with one or more of the first fasteners for preventing one or more of the first fasteners from disengaging. Alternatively or additionally to one or more of the examples disclosed above, in some examples the method further comprises aligning a second aperture formed in the lower tap portion and a plug formed with the upper tap portion; and retaining the plug within the second aperture and engaging the lower tap portion with the upper tap portion.

Some examples of the disclosure are directed to a tap apparatus for attachment to a shoe, comprising: an upper tap portion having one or more first apertures configured for receiving one or more first fasteners and enabling attachment of the upper tap portion to the shoe, and one or more second apertures configured for receiving one or more second fasteners; and a lower tap portion having one or more third apertures configured for receiving the one or more second fasteners and engaging the lower tap portion with the upper tap portion. Alternatively or additionally to one or more of the examples disclosed above, in some examples one or more of the third apertures and one or more of the second fasteners are threaded for threaded engagement with each other. Alternatively or additionally to one or more of the examples disclosed above, in some examples one or more of the second apertures includes one or more recessed ledges for supporting the one or more second fasteners. Alternatively or additionally to one or more of the examples disclosed above, in some examples the one or more second apertures are formed as notches. Alternatively or additionally to one or more of the examples disclosed above, in some examples the tap apparatus further comprises a recess formed at a distal end of one or more of the second fasteners and configured for insertion of a tool to rotate the one or more second fasteners. Alternatively or additionally to one or more of the examples disclosed above, in some examples the tap apparatus further comprises one or more cavities formed between the upper tap portion and the lower tap portion when the upper tap portion and the lower tap portion are engaged. Alternatively or additionally to one or more of the examples disclosed above, in some examples one or more of the first fasteners comprises a screw and screw post combination. Alternatively or additionally to one or more of the examples disclosed above, in some examples the tap apparatus further comprises one or more raised areas formed with the lower tap portion and configured for alignment with one or more of the first fasteners for preventing one or more of the first fasteners from disengaging.

Some examples of the disclosure are directed to a method for attaching a tap apparatus to a shoe, comprising: affixing an upper tap portion to the shoe using one or more fasteners retained within one or more first apertures; supporting one or more second fasteners within one or more second apertures formed in the upper tap portion; and receiving the one or more second fasteners through one or more third apertures in a lower tap portion to engage the lower tap portion with the upper tap portion. Alternatively or additionally to one or more of the examples disclosed above, in some examples the method further comprises threadably engaging one or more of the second fasteners and one or more of the third apertures. Alternatively or additionally to one or more of the examples disclosed above, in some examples the method further comprises supporting the one or more second fasteners on one or more recessed ledges within one or more of the second apertures. Alternatively or additionally to one or more of the examples disclosed above, in some examples the method further comprises forming the one or more second apertures as notches. Alternatively or additionally to one or more of the examples disclosed above, in some examples the method further comprises inserting a tool through one or more of the third apertures into a recess formed at a distal end of one or more of the second fasteners to rotate the one or more second fasteners. Alternatively or additionally to one or more of the examples disclosed above, in some examples the method further comprises forming one or more cavities between the upper tap portion and the lower tap portion when the upper tap portion and the lower tap portion are engaged. Alternatively or additionally to one or more of the examples disclosed above, in some examples one or more of the first fasteners comprises a screw and screw post combination. Alternatively or additionally to one or more of the examples disclosed above, in some examples the method further comprises: forming one or more raised areas with the lower tap portion in alignment with one or more of the first fasteners for preventing one or more of the first fasteners from disengaging.

Some examples of the disclosure are directed to a tap apparatus for attachment to a shoe, comprising: means formed in an upper tap portion for affixing the upper tap portion to the shoe; means formed in the upper tap portion for supporting one or more fasteners; and means formed in a lower tap portion for receiving the one or more fasteners to engage the lower tap portion with the upper tap portion. Alternatively or additionally to one or more of the examples disclosed above, in some examples the tap apparatus further comprises means for threadably engaging one or more of the fasteners and one or more of the third apertures. Alternatively or additionally to one or more of the examples disclosed above, in some examples the tap apparatus further comprises means provided in the lower tap portion and one or more of the fasteners for enabling a tool to rotate the one or more fasteners. Alternatively or additionally to one or more of the examples disclosed above, in some examples the tap apparatus further comprises: means formed with the lower tap portion in alignment with the means for affixing the upper tap portion to the shoe for preventing disengagement of the upper tap portion and the shoe.

Some examples of the disclosure are directed to a tap apparatus for attachment to a shoe, comprising: an upper tap portion; and a tab formed with the upper tap portion and configured for retention with a first aperture formed in a lower tap portion. Alternatively or additionally to one or more of the examples disclosed above, in some examples the tap apparatus further comprises: the lower tap portion; and the first aperture formed with the lower tap portion and configured for retaining the tab formed with the upper tap portion. Alternatively or additionally to one or more of the examples disclosed above, in some examples the tap apparatus further comprises a plurality of first fasteners configured for pivotably engaging the upper tap portion and the lower tap portion. Alternatively or additionally to one or more of the examples disclosed above, in some examples the tap apparatus further comprises a plurality of second apertures formed in a plurality of bent tabs in the upper tap portion for retaining the plurality of first fasteners. Alternatively or additionally to one or more of the examples disclosed above, in some examples the plurality of second apertures and the plurality of first fasteners are threaded for threaded engagement of the plurality of second apertures and the plurality of first fasteners. Alternatively or additionally to one or more of the examples disclosed above, in some examples the upper tap portion and lower tap portion are configured to form one or more cavities between the upper tap portion and the lower tap portion when the upper tap portion and the lower tap portion are engaged. Alternatively or additionally to one or more of the examples disclosed above, in some examples the tap apparatus further comprises one or more second apertures formed in the upper tap portion and configured for enabling attachment of the upper tap portion to the shoe. Alternatively or additionally to one or more of the examples disclosed above, in some examples the tap apparatus further comprises one or more first fasteners configured for enabling attachment of the upper tap portion to the shoe. Alternatively or additionally to one or more of the examples disclosed above, in some examples one or more of the first fasteners comprises a screw and screw post combination. Alternatively or additionally to one or more of the examples disclosed above, in some examples the tap apparatus further comprises one or more raised areas formed with the lower tap portion and aligned with one or more of the first fasteners for preventing one or more of the first fasteners from disengaging.

Some examples of the disclosure are directed to a method for attaching a tap apparatus to a shoe, comprising: affixing an upper tap portion to the shoe using one or more first fasteners retained within one or more first apertures; and retaining a tab formed with the upper tap portion with a second aperture formed in a lower tap portion to engage the upper tap portion with the lower tap portion. Alternatively or additionally to one or more of the examples disclosed above, in some examples the method further comprises pivotably engaging the upper tap portion and the lower tap portion with a plurality of second fasteners. Alternatively or additionally to one or more of the examples disclosed above, in some examples the method further comprises a plurality of third apertures formed in a plurality of bent tabs in the upper tap portion for retaining the plurality of second fasteners. Alternatively or additionally to one or more of the examples disclosed above, in some examples the method further comprises threadably engaging the plurality of third apertures and the plurality of second fasteners. Alternatively or additionally to one or more of the examples disclosed above, in some examples the method further comprises forming one or more cavities between the upper tap portion and the lower tap portion when the upper tap portion and the lower tap portion are engaged. Alternatively or additionally to one or more of the examples disclosed above, in some examples the method further comprises forming one or more raised areas with the lower tap portion in alignment with one or more of the first fasteners for preventing one or more of the first fasteners from disengaging.

Some examples of the disclosure are directed to a tap apparatus for attachment to a shoe, comprising: means formed in an upper tap portion for affixing the upper tap portion to the shoe; and means formed with the upper tap portion for retention with an aperture formed in a lower tap portion to engage the upper tap portion with the lower tap portion. Alternatively or additionally to one or more of the examples disclosed above, in some examples the tap apparatus further comprises means for pivotably engaging the upper tap portion and the lower tap portion. Alternatively or additionally to one or more of the examples disclosed above, in some examples the tap apparatus further comprises means formed in both the upper tap portion and the lower tap portion for retaining a plurality of second fasteners and providing the pivotable engagement of the upper tap portion and the lower tap portion. Alternatively or additionally to one or more of the examples disclosed above, in some examples the tap apparatus further comprises means formed with the lower tap portion in alignment with the means for affixing the upper tap portion to the shoe for preventing disengagement of the upper tap portion and the shoe.

Some examples of the disclosure are directed to a tap apparatus for attachment to a shoe, comprising a tap portion having one or more first apertures configured for receiving one or more screws; and one or more screw post and screw combinations; wherein each screw in the combination is configured for insertion through one of the first apertures; wherein each screw post in the combination is configured for insertion through one or more second apertures associated with the shoe, and wherein the screw post and screw in each combination are configured for threadably engaging with each other to secure the tap portion to the shoe. Alternatively or additionally to one or more of the examples disclosed above, in some examples the tap apparatus is incorporated with the shoe, the shoe including a sole having the one or more second apertures configured for receiving the one or more screw posts. Alternatively or additionally to one or more of the examples disclosed above, in some examples one or more of the screw posts includes a flange for engaging with the sole, the flange configured for preventing the screw post from pulling through one of the second apertures. Alternatively or additionally to one or more of the examples disclosed above, in some examples the tap apparatus is incorporated with the shoe, the shoe including a soundboard having the one or more second apertures configured for receiving the one or more screw posts. Alternatively or additionally to one or more of the examples disclosed above, in some examples one or more of the screw posts includes a flange for engaging with the soundboard, the flange configured for preventing the screw post from pulling through one of the second apertures.

Some examples of the disclosure are directed to a method for attaching a tap apparatus to a shoe, comprising: inserting a screw of each of one or more screw post and screw combinations through one or more first apertures of a tap portion; inserting a screw post of each of the one or more combinations through one or more second apertures associated with the shoe; and threadably engaging the screw and screw post in each of the one or more combinations to secure the tap portion to the shoe. Alternatively or additionally to one or more of the examples disclosed above, in some examples the method further comprises inserting the screw post of each of the one or more combinations through the one or more apertures in a sole of the shoe. Alternatively or additionally to one or more of the examples disclosed above, in some examples the method further comprises engaging a flange of one or more of the screw posts with the sole to prevent the screw post from pulling through the one or more of the second apertures. Alternatively or additionally to one or more of the examples disclosed above, in some examples the method further comprises inserting the screw post of each of the one or more combinations through the one or more apertures in a soundboard of the shoe. Alternatively or additionally to one or more of the examples disclosed above, in some examples the method further comprises engaging a flange of one or more of the screw posts with the soundboard to prevent the screw post from pulling through the one or more of the second apertures.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the appended claims.

What is claimed is:

1. A tap apparatus for attachment to a shoe, comprising:

an upper tap portion configured to attach to a soundboard or a sole of the shoe, the upper tap portion including one or more second apertures;

a lower tap portion including one or more third apertures aligned with the one or more second apertures in the upper tap portion; and a tab formed with the upper tap portion inserted into and retained within a first aperture formed in the lower tap portion;

wherein the upper and lower tap portions are coupled together at the one or more second apertures and the one or more third apertures using one or more first fasteners;

wherein the lower tap portion pivots with respect to the upper tap portion about a pivot point centered at the one or more first fasteners.

2. The tap apparatus of claim 1, further comprising one or more bent tabs in the upper tap portion with the one or more second apertures formed therein for retaining the one or more first fasteners.

3. The tap apparatus of claim 2, wherein the one or more second apertures and the one or more first fasteners are threaded for threaded engagement of the one or more second apertures and the one or more first fasteners.

4. The tap apparatus of claim 1, wherein the upper tap portion and lower tap portion are configured to form one or more cavities between the upper tap portion and the lower tap portion when the upper tap portion and the lower tap portion are engaged.

5. The tap apparatus of claim 1, further comprising one or more fourth apertures formed in the upper tap portion and configured for enabling attachment of the upper tap portion to the shoe.

6. The tap apparatus of claim 5, wherein the one or more fourth apertures are configured for engaging with one or more second fasteners for enabling attachment of the upper tap portion to the shoe.

7. The tap apparatus of claim 6, wherein one or more of the second fasteners comprises a screw and screw post combination.

8. A method for attaching a tap apparatus to a shoe, comprising:

affixing an upper tap portion to the shoe such that the upper tap portion is configured to attach to a soundboard or sole of the shoe using one or more first fasteners retained within one or more first apertures formed in the upper tap portion;

inserting and retaining a tab formed with the upper tap portion within a second aperture formed in a lower tap portion to engage the upper tap portion with the lower tap portion;

coupling the upper tap portion and the lower tap portion using one or more second fasteners engaged within one or more third apertures formed in the upper tap portion and one or more fourth apertures formed in the lower tap portion; and pivotably engaging the upper tap portion and the lower tap portion with the one or more second fasteners.

9. The method of claim 8, further comprising forming the one or more third apertures in one or more bent tabs in the upper tap portion.

10. The method of claim 9, further comprising threadably engaging the one or more third apertures and the one or more second fasteners.

11. The method of claim 8, further comprising forming one or more cavities between the upper tap portion and the lower tap portion when the upper tap portion and the lower tap portion are engaged.

12. A tap apparatus for attachment to a shoe, comprising:

an upper tap portion, a lower tap portion, a first aperture and one or more third apertures formed in the lower tap portion, one or more second apertures formed in the upper tap portion, means formed in the upper tap portion for affixing the upper tap portion to the shoe such that the upper tap portion is configured to attach to a soundboard or sole of the shoe;

means formed with the upper tap portion for insertion and retention within the first aperture formed in the lower tap portion to engage the upper tap portion with the lower tap portion; and means for coupling the upper tap portion and the lower tap portion using the one or more second apertures formed in the upper tap portion aligned with the one or more third apertures formed in the lower tap portion;

wherein the lower tap portion pivots with respect to the upper tap portion about a pivot point centered at the means for coupling.

* * * * *